US010900659B2

(12) United States Patent
Malavasi et al.

(10) Patent No.: US 10,900,659 B2
(45) Date of Patent: Jan. 26, 2021

(54) STEAM GENERATOR

(75) Inventors: Massimo Malavasi, Milan (IT); Guido Volpi Ghirardini, Milan (IT); Claudio Citti, Gorla Maggiore (IT); Alessandro Saponaro, Bari (IT)

(73) Assignee: ITEA S.P.A, Bologna (IT)

( * ) Notice: Subject to any disclaimer, the term of this patent is extended or adjusted under 35 U.S.C. 154(b) by 584 days.

(21) Appl. No.: 13/383,784

(22) PCT Filed: Jul. 21, 2010

(86) PCT No.: PCT/EP2010/060558
§ 371 (c)(1),
(2), (4) Date: Jan. 12, 2012

(87) PCT Pub. No.: WO2011/012516
PCT Pub. Date: Feb. 3, 2011

(65) Prior Publication Data

US 2012/0111288 A1 May 10, 2012

(30) Foreign Application Priority Data

Jul. 28, 2009 (IT) ..... MI2009A1336

(51) Int. Cl.
*F22B 29/06* (2006.01)
*F22B 35/10* (2006.01)

(52) U.S. Cl.
CPC ..... *F22B 29/06* (2013.01); *F22B 35/105* (2013.01); *F22B 35/108* (2013.01)

(58) Field of Classification Search
CPC ..... F22B 29/067; F22B 37/142; F22B 29/06; F22B 35/105; F22B 35/108; F22G 3/006
USPC ..... 122/235.15, 235.23
See application file for complete search history.

(56) References Cited

U.S. PATENT DOCUMENTS 3,213,835 A 10/1965 Egglestone
3,232,282 A * 2/1966 Gfrerer ..... 122/510
3,395,678 A * 8/1968 Kochey, Jr. ..... 122/406.4
4,331,105 A * 5/1982 Kawamura et al. ..... 122/406.4
4,862,692 A * 9/1989 Fukuda et al. ..... 60/670
(Continued)

FOREIGN PATENT DOCUMENTS

DE 944 856 C 6/1956
DE 19 63 633 A1 6/1971
(Continued)

*Primary Examiner* — Steven B McAllister
*Assistant Examiner* — Benjamin W Johnson
(74) *Attorney, Agent, or Firm* — Silvia Salvadori, P.C.; Silvia Salvadori

(57) ABSTRACT

A steam generator comprising water/steam tubes passing through the steam generator from the water inlet to the superheated steam outlet, horizontally arranged in tube banks, preferably flat tube banks, perpendicularly crossed by the fumes, the tubes ascend along the steam generator axis from one tube bank the other, with an oblique path so to expose the tube to the fume flow in different positions at each tube bank, the tubes are divided into two or more separate branches, each branch fed by a header distinct from the others, the steam generator being once-through in pure counter-current, vertical or horizontal, the headers of the outlet superheated steam are grouped at direct contact in a bundle, and they are thermally insulated from the outside.

15 Claims, 19 Drawing Sheets

(56) References Cited

U.S. PATENT DOCUMENTS

| | | | | |
|---|---|---|---|---|
| 4,953,477 | A * | 9/1990 | Martin | F23N 1/022 110/190 |
| 5,687,676 | A * | 11/1997 | Kai et al. | 122/6 A |
| 5,730,088 | A | 3/1998 | Foley et al. | |
| 2007/0214766 | A1* | 9/2007 | Obana et al. | 60/39.15 |
| 2008/0148739 | A1* | 6/2008 | Paul | 60/805 |

FOREIGN PATENT DOCUMENTS

| | | | |
|---|---|---|---|
| FR | 1 068 954 | A | 7/1954 |
| FR | 1 212 856 | A | 3/1960 |

* cited by examiner

STEAM GENERATOR

CROSS-REFERENCED TO RELATED APPLICATION

This application is a National Stage entry of International Application No. PCT/EP2010/060558, filed Jul. 21, 2010, which claims priority to Italian Patent Application No. MI2009A001336, filed Jul. 28, 2009, the disclosure of the prior applications are incorporated in their entirety by reference.

The present invention relates to steam generators endowed with high flexibility, made of materials, also comparable with those used in conventional steam generators. The steam generators of the present invention are capable to substantially expand the flexibility towards low loads (<30%), up to the limit of a night stand-by condition (load at least lower than 10%, preferably higher than or equal to 5%) in constant temperature profile control condition, and ready to rapidly rise up to maximum load according to the requests, even with fuels, as coal, that historically have been confined in continuous (non flexible) production uses.

It is known in the art that the thermal-electrical power production is technologically very diversified along the various types of fuels and the different thermodynamic cycles used.

However, all the technological solutions, both those already known and those still at the development stage, have a conceptually common feature, even if structurally different in the equipments, represented by the thermal recovery operations, under the form of heat, from combustion gas/fumes unsuitable as such to provide mechanical work, towards the operating fluid of a closed cycle which, by exploiting the hot source, is able to produce mechanical work. Generally the most diffused fluid is water/steam, which operates a Rankine cycle (feature always present today) wherein the isoentropic expansion of the steam in a turbine is performed. The thermal recovery equipments are called generators (SG).

The evolution of the heat-recovery steam generators took place according to some guide criteria.

The continuous increase of the cost of fossil fuels and the need to drastically reduce the amount of harmful emissions, comprising recently the "greenhouse" gases, per unit of power produced, they have in fact pushed towards higher and higher yields of thermal power-electric power transformation, even accepting the drawback of more complex and expensive technologies and plants.

As well known, higher cycle yields are associated to water/steam cycles operating at higher pressures and in particular at higher temperatures. By assuming as reference the pressure and temperature steam critical values, i.e. 22.1 MPa (221 bar), and 647 K (374° C.) it has been industrially experienced the move from sub-critical cycles to supercritical (SC) cycles up to the recent ultra-supercritical cycles (USC). Therefore in order to maximize the yields, today USC cycles operating at pressures of 240-280 bar and temperatures of 600-620° C. of the superheated steam are used, wherein the thermal recovery takes place by heating the water fluid without going through the typical two-phase transition state, with the presence of both liquid water and steam at once. The liquid water passes by heating in a continuous manner from the liquid phase to the steam phase, without an intermediate step through the liquid-steam two-phases typical of the steam generators operating under sub-critical conditions. In the USCs one passes from a high density phase (water-like) to a low density phase (steam-like) without the presence of a phase wherein liquid-water and steam-water are contemporaneously present.

The remarkable complexity of the handling of the heat exchange water/steam side has represented the key point in the technological choices for the sub-critical steam generators. In fact, it is important to note that the steam generator:

- fume side, it removes heat from a gas at atmospheric pressure and under conditions near to the quasi-linearity of the heat to be removed (sensitive heat) vs temperature, due to the quasi-linearity of the thermal characteristics (specific heat) and of the transport characteristics (viscosity, specific heat, thermal conductivity) as a function of the temperature, thus easing the engineering of the solutions;
- water-steam side, it transfers heat to a rather complex system, with substantial variations of the thermal and transport characteristics, of physical state and of the relevant enthalpy of vaporization and, under subcritical conditions, of mixed phases along the state transition with a strongly variable ratio between liquid and steam phases.

Therefore, the heat exchange takes place with very different temperature gradients between fumes and water liquid/steam, low in the water liquid preheating zone, high in the evaporation and steam superheating zone, with "pinch" problems (deltaT fumes-water/steam which is restricted to values near to zero of the heat exchange at the boundary between the preheating zone and the evaporation zone.

A system therefore very complex to be designed and operated according to efficiency and handling, which is represented by three well distinct zones, even if physically incorporated in a single equipment body: liquid preheating (ECO), evaporation (mixed liquid and steam phase, EVA), steam superheating (SH), each zone optimized according to specific criteria and controlled according to specific criteria. Each of these zones is thus equipped with different and independent instruments, control units and accessory circuits, i.e. the steam generator is conceptually and really separated into three different operations/equipments.

In particular, established solutions set the evaporation phase (EVA) confined by phase separators and large steam drums for the clear-cut separation of the water from the produced saturated steam, and stabilized through little varied heat exchange and fluid-dynamic conditions of the mixed phase, that is wherein limited amounts of steam are formed in large recirculated water masses.

This solution has been the most preferred, consolidated by its large use and by the appreciable characteristics of great stability in the control, favoured by the inertia given by the large water masses contained in steam drums (large vessels at high temperature and pressure), and appreciated for the large thermal power stations, which have been historically part of the backbone supplying of the continuous stock (i.e the night minimum of EP consumption) of power to the distribution networks.

The evolution of the subcritical to SC steam generators, towards the USC ones, it has from one side partially deprived the meaning of the distinction in three separated distinct zones and of the large water/steam separator systems. However the criterium of the distinction in three zones (ECO, EVA, SH) is still to be maintained, as the partialization of the power load takes place, on the thermal-electrical power conversion machines (turbines), through the sliding pressure concept (reduction of the steam pressure). In fact, the USC steam generators, when the steam generation pressure decreases below the critical pressure, they turn back to the subcritical conditions (appearance of two-phase water and steam, along the heating curve). In other words the power production can be modulated in a continuous way (almost constant temperature profile control) from the nominal value down to the limit of about 30% with respect to the nominal power at constant. Instead, under the 30% load, depending on the various adopted solutions, dedicated starting systems are used.

Lastly, the power generation had to take into account the trends during the whole day of the power consumptions. The evolution of the industrial and consumer system demand has brought in a sensitive increase of power consumption during the day hours, with a ratio between day hours/night hours power demand well above 3, and with abnormal peaks of request with respect to the continuous base consumption (night hours). This is known as (daily) "cycling".

Production side, the generation of continuous power at full load has historically been a prerogative of the large plants with low variable costs, i.e. the nuclear, and of the thermal plants mainly coal-fired ones, leaving the absorption of day demand and peaks (cycling) to intrinsically quick-responsive technologies for the start up and for the power load increase/decrease with respect to the nominal load, such as the technologies based on turbo-gas cycles. This scheme has been able to absorb the cycling at least until not long ago.

However it has to be remarked that other developing factors create an unbalance:

- the divergent trend of day and night power consumptions is expected to further increase, reducing the continuous base consumption (night hours),
- the increase of the nuclear power, which will insist on the same continuous base consumption, will erode room to thermal power technologies using fossil fuels (coal),
- higher yield need has impacted also the above mentioned intrinsically quick technologies, causing the evolution from the simple turbo-gas to the combined cycle turbo-gas (addition of a steam generator for heat recovery from hot fumes discharged by the turbo-expander) and in the future to the combined cycle with USC type high recovery yield steam generator.

The cycling requirements exclude for the combined cycles the conventional "steam drum" steam generators, too slow in the load variation, and have given new solutions, of which there is evidence already at least for the so called fast response plants.

All these evolution factors notably pushed towards new solutions, possibly conceived in combination with the new technologies to be developed for near-zero emission target from fossil fuels. As said above, a new solution already apparent today relates to heat recovery steam generators of combined (quick) cycles.

The daily cycling and the quick response to load variations have required to dismiss the use of steam drum, i.e. of the three-phase scheme, and the switching to a much more flexible scheme known as "once through", literally single-pass water/steam side.

For example, the pure countercurrent scheme has been established, i.e. fluids passing through the equipment in opposite directions, and with contact/exchange, through a wall, between hot fumes and hot steam on one side, throughout to cold fumes in contact with cold water to be preheated, i.e. at minimized heat-exchange deltaT. The equipment is vertical—the fumes rise from the bottom crossing tube banks of horizontal water/steam tubes and water downcomes from the top "once through".

The flexibility is obtained by:

- start up of the steam generator with dry tubes (without water) for eliminating the additional thermal inertia of the water sensitive heat to be supplied,
- absence of accumulated water (steam drum, water/steam separators) for minimizing the regulation inertia with the load variations (load variation in sliding pressure),
- heavy (high specific gravity) fluids (water and mixed phases water/steam in subcritical conditions; and water, at temperatures below the critical temperature, in supercritical conditions) downcome, literally fall down, towards the low density fluid zones (steam, low density water at temperatures greater than the critical temperature (Tcr)), In this way the problems of slug flow, (plug flow) are overcome. In fact, these problems would arise in the case of upward water/steam flow, for schemes with simple tube passing uninterrupted through the whole steam generator, for all the high water/steam ratios along the evaporation zone.

An example of pure countercurrent scheme, applied at sub-critical conditions, it is the IST one of the AECON group. Specifically it resolves, at high and intermediate water/steam ratio flow, the problems of steam segregation in bubbles from a still low speed water flow, and later on, at lower ratios, of water stratified and wavy flow with superheating of the tube ceiling, followed by projection of water on the tube ceiling (slug flow, plug flow), and subsequent peeling of the metal wall.

However with the load variation, and especially at low loads, in particular lower than about 30%, the problems due to temperature profiles along the water path very different from those of the maximum load are not overcome, and in particular the extension to most of the tube length of temperatures near the temperature of the inletting hot fumes are not overcome. It follows that for most of the exchange surface the tubes must be made of high alloyed materials (alloys with high nickel content, and other valuable metals), with consequent higher costs. The use of high-alloyed materials in the exchange surfaces becomes evident in case of an equipment of this type inserted downstream a carbon combustion reactor of the prior art.

Furthermore, the "once-through" scheme with "downcoming" water requires a vertical installation of the plant. This is a limit of capex relevance particularly for the large power units. Finally, it is worth noticing, apart the pipe high temperature extension mentioned above, that in order to quickly move the load up or down it is necessary that the operations can be carried out with constant temperature profile control (that means for steam generators to maintain the temperature profiles of fumes and water/steam in the same alignment and geometrical position in the steam generator, condition known in the prior art as constant temperature profile control condition, or "profile control"), which is not the case, for the IST boiler, over an ample load interval.

Therefore the undoubted flexibility of this embodiment, that is the quick up and down load variation at constant temperature profile control, it is attenuated until to disappear at loads lower than 30%. In fact, the managing/control of remarkable portions of the steam generator, at various steam/water ratios and at low steam flow rate, owing to the low load, it is no more supported by the sole water downflow and it requires progressively different control strategies and thus not operable in real time.

The concern that the water down-flow by gravity can cause unacceptable risks of turbine damage, in transient condition (start-up/stop) and at low load conditions (<30%), by unacceptable deviation from the steady state (water/ steam ratio) of the water/steam flow, and to maintain anyway for a substantial part of the steam generator low deltaTs (for the previously reported reasons), it is apparent in the invention U.S. Pat. No. 5,159,897. In this patent the "once through" scheme, with hot fumes from the bottom and water from the top, it is combined with an intermediate zone wherein the two-phase water/steam fluid (evaporating water) returns to rise (against gravity) in co-current flow with the fumes, delimiting a zone wherein preferably the water to be evaporated is contained, which at low loads would move towards the outlet in non steady conditions. Furthermore, being the water/steam phase transition (in subcritical conditions) an isothermal phenomenon, the entropic inefficiency of the co-current heat exchange results negligible. However at USC full load conditions the entropic inefficiencies come back of relevance and the flexibility at low loads is obtainable only by extending anyway the exchange surface portion made of high-alloyed materials.

The concern of the high deltaT (materials, peeling), and of thermal shock during the quick load variations, it is apparent in U.S. Pat. No. 7,383,791 wherein the "once through" scheme (an uninterrupted single tube from the inlet to the outlet) designs the water path so that the rising flow of hot fumes comes first into contact with water to be preheated, in order to limit the deltaT in the steam generation zone SH (maximum of the fluid temperature to be heated) and the thermal shock risks in the evaporation zone. The water therefore enters from the bottom and is preheated with the hot fumes, outlets and renters at the top in down-flow, countercurrent with the rising fumes for the water/steam evaporation phase and the superheating phase.

Undoubtedly, the deltaT fumes water/steam is more limited with respect to the previous cases (IST), and less valuable materials can be used for a larger portion of the heat exchange surface. However it is apparent this is at the expense of the global yield of the cycle, given the entropy formation associated to the hot fume-water heat exchange in the preheating step.

Although the above described cases introduce, in the operation, flexibility improvements (load variation rate) to the detriment of the efficiency or at the expenses of a larger use of expensive high alloyed materials, for them and for the other consolidated solutions the problem still remains that for loads lower than 30% the steam generator significantly departs from the optimal thermal profile (tube bank temperatures, water/steam and fumes temperature profile) of the full load (deviation from the optimal temperature profile control established for high load). It results therefrom that, for the start up and for the running at load up to 30%, it is necessary to quit the high load control condition and carry out a series of operations with various logics and with the use of accessory circuits/hardware. This implies a tangible penalization in terms of the start-up rate and for the load rising up to 30%, and of the control condition complexity. For power plant types, such as the combined-cycle turbogas, which distinguish themselves for quick start and quick rising load performance, the penalization has significant economic impact. Specifically, the steam generator of the combined cycles is the element that determines the start and the load rising rate, that imposes delays of the order of tenths of minutes, up to over one hour.

Various schemes have been studied in order to try to limit the negative impact thereof. One proposes to disconnect the steam generator from the turbogas, by creating a bypass of hot fumes directly sent to the chimney without passing through the steam generator. Another scheme proposes to modulate (by reducing) the turbogas power, via number of revolutions and fuel, by sending all the fumes to the steam generator, with modulation (fumes flow-rate and fumes temperature) based on the startup procedure and on the load rising performance of the steam generator.

The leaving from the temperature profile control condition forcedly takes place also because the heat exchange flux at high temperature is not based on a single well known mechanism (forced convection), but on two:

- the exchange by forced convection, that rises-descents consistently (in an almost linear way) with the load, i.e. with the fume flow rates and with the fume temperature (deltaT),
- the exchange by irradiation from fumes that depends only from the temperature (T) at the 4th power, i.e. ($T^4$), wherein the second mechanism is non negligible at high temperature.

Depending on the upstream fumes generating plant (combustion, hot fume generator) one will have:

- for an upstream turbogas, wherein the flexibility at low loads is not significant and instead the start rate and load rising rate are predominant, which in the ideal case operates at a constant fumes flow rate and tunes the load by modulating the temperature, the descent (rising) load variation implies a significant deviation of the heat flux exchange from linearity with load as it cannot avoid/minimize the impact of the second mechanism (exchange by irradiation),
- for an upstream oil or coal combustion radiant chamber, which modulates the load only with the flow rate at a constant temperature, the contribution to heat flux by irradiation from fumes is invariable and heat flux lower than the radiative one is not permitted.

Therefore, in the operations below 30% load, the temperature profile control cannot be maintained and different control logics, the more different the more the load decreases, are to be progressively taken, and often with the use of accessory circuits (external recirculations, water injection-modulation into steam) which interrupt the single tube path. That is, the steam generator cannot be operated extending the automatic temperature profile control to the whole range below 30% load (both in rising and in descent) as well as in the start/stop phases.

The need was therefore felt to have available steam generators having the following combination of properties

- endowed with high flexibility and, also, made of materials comparable with those used in established steam generators,
- capable to substantially expand the flexibility towards low loads (<30%), up to the limit of a night stand-by condition (load at least lower than 10%, preferably higher than or equal to 5%) working at constant temperature profile control,
- ready to quickly raise back to maximum load according to the requests, even with fuels, as coal, that historically have been confined in steady high load production uses.

It is to be remembered in fact that, for the characteristics of the turbines, the specific yield to produce power for fuel unit (kWhr produced/Kjoule heat of combustion) significantly decreases as the load decreases, up to unacceptable values (about 15%) at plant loads of 30%, i.e. at the lower load limit suitable to temperature profile control.

The Applicant has surprisingly and unexpectedly found a steam generator solving the above described technical problem and capable to satisfy the high efficiency and cycling requirements, and of reduced costs (conventional materials of the prior art).

It is an object of the present invention a steam generator comprising

- water/steam tubes passing through the steam generator from the water inlet to the superheated steam outlet,
- the water/steam tubes are horizontally arranged in tube banks, preferably flat tube banks, perpendicularly crossed by the fumes,
- the tubes go along the steam generator axis from one tube bank to the other, with an oblique path, so to expose to the fume flow in a different position at each tube bank (see FIG. 1),
- the tubes are divided into two or more separate branches, each branch fed by a header distinct from the others (see FIG. 5),
- the steam generator being once-through in pure countercurrent flow, vertical with fume inlet from the top and water inlet from the bottom, or horizontal, but always in countercurrent flow,
- the headers of the outlet superheated steam are grouped with direct contact in a bundle, and the bundle is thermally insulated from the outside,
- optionally, the header starts are located in the fume flow, in such a position that the fumes are at a temperature near the superheated steam temperature (see FIG. 6),
- optionally, temperature modulation of the inlet hot fumes by recycling the cold fumes after heat recovery,
- optionally, one or more re-heating sections deriving from turbine intermediate pressure spillage are present,
- optionally one or more steam pressure levels for the re-heating can be present.

The water/steam tubes preferably pass through the steam generator from the water input to the superheated steam output preferably without intermediate inlets and outlets, more preferably without interruption. The water-steam tubes can be made of materials normally used in conventional USC steam generators.

Generally the used materials vary depending on the operating temperature to which they are subjected along the steam generator axis. In the steam generator of the invention the high-alloyed material section is only that corresponding to the last part wherein the final steam superheating is performed. For example, if the steam outlets at 605° C. and at a pressure of 240-280 bar, the length of this part corresponds to about 10% of the tube length. After the first part in high-alloyed material, there is in sequence a cascade of materials preferably comprising chromium steels, the most of the tube length (about 60%) preferably made of carbon steel.

The water/steam tubes arranged in flat banks, perpendicularly crossed by fumes, have preferably a relatively limited rectilinear horizontal tube length, generally preferably lower than 12 meters, still more preferably lower than 6 meters.

These dimensions are used to avoid too long rectilinear horizontal sections, which favor the appearance of periodic water accumulation and plug flow (or slug flow) propagation. Therefore, although the minimum operating load of the tube is about 30%, in the steam generators of the invention shorter lengths, as said, are preferred, followed by remixing (curves, more frequent ascents) in order to avoid plug flow phenomenon and its propagation. When ribbed tubes are used, see below, the tube length can be even longer, for example of 20 meters.

The tubes ascending with an oblique path between a tube bank and the other one are described in detail later on. The water/steam tubes are divided in two or more separate branches, separately fed, as described in detail hereinafter.

The headers are preferably positioned according to criteria described in detail afterwards.

The steam generator of the invention is once through vertical in pure countercurrent, preferably with fume inlet from the top and water inlet from the bottom.

Preferably, the "once-through" pure countercurrent steam generator of the invention is horizontal. In this way the industrial installation is simplified and thus a substantial reduction of the installation costs is achieved. This point is more widely illustrated later on.

The temperature modulation of the inletting hot fumes is preferably operated by recycling cold fumes after recovery, as described afterwards when the advantages concerning the superheated steam control and pinch elimination are illustrated.

It is a further object of the invention a process for operating the steam generator of the invention in sliding pressure modality, with water/steam always in supercritical conditions at 100% load (FIG. 7A) and with pressure more and more lower with decreasing load (FIG. 7B for a 50% load), in order to obtain steam at the steam generator outlet having the requested pressure conditions for the injection into the turbine running at the targeted load.

Optionally the steam generator can be operated in constant pressure modality, with the water/steam in the steam generator always at supercritical conditions for all the loads (from 100% to 30% load) and final lamination before injection into a turbine (FIG. 7C for 50% load).

It is a further object of the invention a process for operating the steam generator of the invention at loads from 5-10% to 100% comprising the following steps:

- maintaining the temperature profiles of the fumes and of the water/steam in the same alignment and same geometrical position of the steam generator,
- heat exchange surface choking at low loads, that is lower than about 30%, by excluding and then maintaining in a dry state one or more branches, up to the limit to have only one operating branch.

Preferably the maintenance of the temperature profile of the fumes and of the water/steam in the same alignment and same geometrical position along the steam generator is performed by two or more of the following procedures:

a) choking of the exchange surface for loads lower than the minimum sliding pressure load (30%), by excluding and then maintaining in a dry state one or more branches, up to the limit to have only one operating branch, b) feedback control (shifting control for deviation from the steady state) of the fed water flow-rate, at any load, by maintaining the position, along the steam generator, of the temperature flex when passing through critical conditions for loads requiring supercritical conditions, and of the vaporization isotherm for loads requiring sub-critical conditions (in sliding pressure), c) feedback control (shifting control for deviation from the steady state) of the produced steam temperature at any load, by hot fume temperature tuning, via recycling cold fumes, to be operated for boilers servicing downstream of solid fuel combustion unit, d) feedback control of the fume temperature at the outlet of the steam generator, by operating on the fed water preheating.

The preferred solution for the maintenance of the temperature profile is the use of the above mentioned steps b) and c).

Optionally the process of the invention comprises the following step e):

maintaining, under all pressure conditions of the produced steam, the first section of the steam generator at supercritical pressure conditions, followed by lamination, when the fluid enthalpy allows, downstream the lamination step, the direct transformation of the supercritical fluid into the steam phase without crossing the two-phase water/steam fluid area (FIG. 7C).

The step of the heat exchange surface choking, when operating at low loads, it is described in detail hereinafter.

The feedback control step c), of the produced steam temperature at any load, by modulating the hot fume temperature, is dealt with further on, where how to maintain the superheated steam temperature, and to avoid pinch phenomena, is reported.

The feedback control step b) of the fed water flow rate at any load by maintaining the temperature flex in supercritical conditions, or of the vaporization isotherm at sub-critical conditions (in sliding pressure) is treated in detail afterwards.

Optionally the process of the invention comprises the optional lamination step e), which may be of interest for horizontal installations in case of high capacity combined cycle plants.

The steam generator of the invention, operated with the above described process, unexpectedly and surprisingly, it is able to offer the above mentioned high performances without significant cost increase. The steam generator of the invention meets the cycling from 5-10% to 100% load, it has a high efficiency and it works without necessarily requiring high alloyed materials for most of the heat exchange (wall) surface.

The present invention makes therefore available steam generators having high flexibility, made of materials of a quality comparable to those of conventional steam generators, able to operate also at very low loads, of the order of 5-10%, working under constant operation and temperature profile control condition, and able to rapidly rise again to the maximum load, also when using solid fuels such as coal.

The steam generator of the invention, with the above mentioned characteristics, shows furthermore the following properties:

steady maintenance of the fume temperature decrease profile along the steam generator structure at all the load conditions, from a minimum of about 5-10% up to 100% load, nearly constant maintaining of the temperature profile (in other words, it moves but does not modify its shape), along the water/steam side of the steam generator, in all load conditions, for both supercritical and subcritical steam production, maintaining always good distribution of the water flow rate in the tubes of a single branch by simple flow orifices (minimum load of the working branch equal to/above 30%), fixing, with the tube oblique direction, of any problem related to an uneven distribution of the fumes flow (fumes flow channels having a different exchange "history", among the total fumes flow), maintaining of a minimal water/steam vs fumes deltaT along the SG, i.e. a good deltaT, choking of heat exchange surface (½, ⅓, ¼, etc.), for example by progressively excluding (stopping water feed and bringing it to a dry state) one or more branches, to maintain the temperature profile control setup down to the load of 30% of a single branch, i.e. up to about 5% overall load in the case of six branches, or of 10% load in the case of three branches, wherein generally 5% to 10% values are equal to the plant stand-by load, solving the deltaT pinch problem, by the flow rate-temperature modulation of the hot fumes at the same overall load value.

Therefore the present invention makes it available:

a deltaT profile of fume-water heat exchange near to the optimal one, determined for the full load, at all load conditions, and thus a heat flux always near the optimal one, both along the steam generator axis and on any plane orthogonal to the steam generator axis, the temperature of the out-of-service (dry) tubes, deviates (higher) from the service operating temperature only for the heat exchange deltaT, owing to the maintenance in all the load conditions of the fume temperature decrease profile in the geometrical position (along the steam generator axis), established for the full load conditions, one unique logic for the constant temperature profile control in the whole load range from 5-10% up to 100%, giving rise to one unique automation logic in the whole load range, very high rate of load increase, or of load decrease rate under feed-forward control, limited only by the characteristic response times of the conventional instruments/equipments, operated at constant temperature profile control logic.

With the above mentioned characteristics, the following desired performances are obtained:

quick start up (with dry tubes), very wide load flexibility, under temperature profile control conditions, down to the limit value of about 5-10% of the thermal load (warm stand-by condition), quick load modulation in the 5-10% up to 100% load range, materials of the tubes conforming to the standards at present used in non flexible plants.

The principle scheme of the invention is simple, similar to an heat exchanger in pure countercurrent, as shown in FIG. 6. It is reported therein, as an example, the partition of the water/steam in three separate branches (tri-partition of the heat exchange surface).

The effect of combining the inlet fume temperature modulation with the poly-partition into branches on the maintenance of the temperature profiles at low loads, and on the use of standard materials, it is evident by comparing (same boundary condition for both) the temperature profile of the water/steam and of the fumes along the steam generator axis, in case of no partition (FIG. 9) and with the process of the invention when there is tri-partition and exclusion of two on the three branches (FIG. 10).

The development of each single heat exchange tube preferably without interruptions from the water inlet to the superheated steam outlet, and the partition into more branches, allows the perfect distribution of the flow rate on each single tube by simple orifices (localized head losses), without energy penalizations for excessive load losses at full capacity or uneven distributions due to insufficient head loss at low loads (5-10%), the minimum load of the operating branch being 30% for achieving the desired total load of 5-10%.

As said, the water/steam is divided in branches, at least branches, preferably 3 branches, still more preferably from 4 to 6 branches. In order to maintaining the desired temperature profile (fume side and water/steam side) when one or more are put out of service, one tube is taken from the header of each branch to form couples, terns, sets of four groups (and so on), so that the branch tubes are always contiguously grouped. See FIG. 5 for the case of three branches.

Always for obtaining the above indicated results, the tube, after having passed through an horizontal tube bank rises obliquely towards the next tube bank for avoiding to form unbalanced fume and water/steam paths and for improving uneven distribution of the fumes, always present in any geometry configuration and the steam generator design (see FIGS. 1, 2, 3 and 4). The oblique rise for occupying the position of the contiguous tube in the next tube bank implies that the tube that has reached the end (the most external position) of the tube bank, returns to the other tube bank end by crossing the whole tube bank front (FIGS. from 1 to 4, in particular FIG. 2).

As said, the surface choking allows to maintain constant the fumes temperature decrease profile, thanks to the fact that one or more branches are excluded from the operation, for example by excluding the water feeding and/or by closing the outlet towards the high pressure superheated steam. By keeping in place the fumes temperature profile, it is obtained furthermore that the out of service branch is brought at most up to the fumes temperature pertaining to the axial position, along the steam generator axis. Furthermore, thanks to hot fumes temperature tuning, via recycled cold fumes admixing, and the superheated steam temperature control linked to the inlet temperature, the deltaT (between fumes and water/steam) of the obtained profile is always very small, including the hot zone. Therefore excessive overheating of out of service tubes, in respect to design operating condition, is excluded; thus, upgrading of the materials, in comparison with the traditionally established sequence of materials used in USC boilers, is not needed.

In FIG. 8 fumes, water/steam, and mechanical design temperatures are reported for the various materials used (in cascade along the steam generator axis) both for a conventional steam generator and of the steam generator of the invention, at a 100% load. In FIG. 9 the same features of FIG. 8 are reported for low load (<30%) in a conventional steam generator, that is without surface choking into distinct branches. From FIG. 9 it is apparent that tubes temperature profile exceeds the project temperatures at low load, and materials upgrading is requested.

On the contrary the fumes temperature profile, obtained by operating with one branch (out of the three in the proposed example, FIG. 10) allows the non operating branches never to exceed, in each point of the steam generator, the design temperatures normally imposed for the USC in operation.

In the steam generator of the invention, the maintaining/control of temperature profile water/steam side, from USC conditions at maximum load downward to lower load by pressure decrease to subcritical conditions (sliding pressure) up to a limit of 30% on one branch or on more branches, it is performed by maintaining the geometrical position, along the steam generator axis, of the temperature inflection point in supercritical conditions, or of the isothermal vaporization temperature in subcritical conditions. The position is sensored by temperature measurements of the water/steam flow. They detect the inflection position or the isothermal vaporization position, and precisely upstream and downstream of the plateau wherein the positive and negative temperature shift from the inflection, or from the isothermal vaporization, takes place. In fact, it has been noticed that the supercritical conditions, though the two-phase isothermal vaporization is absent, correspondingly show a marked temperature inflection point (quasi-isothermal), and of pronounced density and enthalpy variation. More precisely, there is a continuity of temperature profile "shape" from subcritical to supercritical, and for the above mentioned parameters. Therefore, with a single logic, the feed-back regulation, operating on the inlet water flow rate, maintains the position of the isothermal, or quasi-isothermal portion, in place, and consequentially the desired temperature profile, that is it maintains heat exchange characteristics and typology.

In the case of installation of the steam generator of the invention downstream a combustors operating with solid fuels, preferably the superheated steam temperature control takes place by modulating the inlet fumes temperature, by recycling cold fumes outletting the steam generator. It has been unexpectedly and surprisingly found that by this control procedure the above mentioned pinch problems can avoided, also. In fact, as said, in any steam generator, heat exchange takes place with very large deltaT (between fumes and water/steam) variations, i.e very low deltaT in the water preheating zone, and very high in the EVA and SH zones, with pinch problems (deltaT which shrinks to values that almost nullify the heat flux) at the boundary between the ECO and EVA zones, every time even limited fluctuations (oscillations) take place (at an apparently constant load), implying unbalances between ECO and the other zones.

On the contrary, in the steam generators of the invention, when the recycle/addition of cold fumes to hot fumes is applied (notice: the hot-cold recycled fumes mixing does not alter the enthalpy balance of thermal recovery), the following conditions are achieved:

- at equivalent loads, various fumes temperature/flow rate couples are operable, the higher temperatures being associated with lower flow rates up to the limit of a fumes recycle equal to zero, and lower temperatures being associated to gradually more and more significant recycle flow rates.
- the low temperature/high flow rate couple reduces the heat exchanged in the SH and EVA zone, so that the fumes reach the ECO zone at a higher flow rate and at a higher temperature.
- Viceversa, the high temperature/low flow rate couple increases the heat exchanged in the SH and EVA zone, by summing higher deltaT and higher irradiation, so that the fumes reach the ECO zone at a low flow rate and at a lower T.

It is thus apparent that the flow rate/temperature couple allows to shift the load among the various zones so as to provide always the requested deltaT at the boundary ECO-zone-EVA zone (deltaT is never reduced to unacceptable values), the typical heat exchange surface for the various zones being assured by regulating the previously described inflection point position. It has been surprisingly and unexpectedly observed that the above pinch regulation is converging with the temperature regulation of the produced superheated steam temperature.

In the steam generator of the invention the steadiness of the temperature profiles in a very wide range allows to reach a good solution also for the collecting headers of the superheated steam.

It is well known in the art that the tube collecting headers have a high thickness due to the larger diameter and to the high design temperature. When they are subjected to sudden temperature shock, they are subjected also to radial differential thermal expansion stress in the wall thickness, which is additive to the stress of continuous working conditions, generating oligo-cyclic (low cycle number) and yet relevant fatigue. This implies limitation of the speed of load increase and consequent limitation of the cycling capability.

The risk of thermal shock, which must be avoided, represents therefore one of the additional elements limiting the quick response to load variations.

In the steam generator of the invention, the maintaining of temperature profiles over a wide operating range (5-10% up to 100% load) allows to identify an axial position along the fumes pathway wherein the temperature of the fumes is kept at about the temperature of the superheated steam (for example about 600° C.). It has been found that by bending down the tubes at the end of the exchange path, aside the tube banks down to the above mentioned point, and preferably by positioning the steam outlet headers in the fume flow (FIG. 6 in an interruption of the tube banks), the deltaT between the header metal wall temperature and the produced steam temperature becomes negligible, and it is lower than about 100° C. in all the conditions, thus eliminating the stress/thermal shock problem. Furthermore it has been verified that, by collecting in a bundle, with direct contact each other, the piping of the poly-partition headers outletting the fume containing vessel, and putting the thermal insulation only around the whole bundle, the dispersed heat by contact/irradiation among the piping is sufficient to bring the temperature of the non operating pipe near the temperature of the working one with steam flow inside. The same happens also in the portion of the piping bundle outside the steam generator.

One of the preferred embodiments of the steam generator of the invention is the horizontal arrangement, as represented in FIGS. 11, 12, 13, 14. In fact, if in addition to the simplicity it is also available an easy accessibility (for maintenance/inspection) and a reduced supporting steelwork, obtainable with the horizontal arrangement, the attractiveness of the steam generator of the invention is even more perceivable.

In U.S. Pat. No. 7,406,928 the horizontal arrangement of the steam generator is obtained by arranging an horizontal coil with straight ascending and descending tubes (raiser and downcomer in series). Furthermore also a preheating zone of the inlet water with hot fumes (with high heat flux) is set out for assuring a rapid heat transfer rate, so that at the first downcomer there is a sufficient two-phase fluid flow rate, capable to enhance the water carryover of vaporized steam bubbles. The rising/downcoming of the tube prevents the establishing of unsteady conditions (water still present far ahead along the steam generator) of water-steam side, a sufficient bi-phase volume fluid flow rate being possibly assured in the part of incipient vaporization in order to avoid water segregation out of the flow and the plug flow.

The implementation of the horizontal arrangement does not however change what observed above for U.S. Pat. Nos. 5,159,897 and 7,383,791, and at most it introduces a further critical element of the plant when it is operated at low loads.

The steam generator of the invention, with an horizontal arrangement not only introduces the above advantages (accessibility and reduced steel-work), but maintains unaltered the above cited advantages of the vertical arrangement for loads from 5-10% to 100%.

It has been surprisingly and unexpectedly found that the conception of the raising obliquely tube is valid also for the horizontal arrangement. In fact, the steam generator rotation of 90° in horizontal position, made by horizontally maintaining the bank tubes, it finds the oblique rise of each tube rotated of 90°, anyway oblique. Or better, an embodiment can be implemented which maintains the desired oblique angle, providing therewith a rise, this time in a direction orthogonal to the steam generator axis, which in all the aspects corresponds to the rise obtained in the vertical arrangement by crossing from the left to the right (or viceversa) along the steam generator axis.

Observed from a side view, the development of the single tube in the connecting elbows among the horizontal parts, follows, along the steam generator axis, a saw-toothed path (it raises obliquely to the end of the fume containment and then downcomes by taking again the lowest position at the other end of the containment; see FIG. 14). This rising path in parts globally carries out that confinement of the water/steam path which prevents unsteady two-phase motions and therefore maintains the desirable performance of the vertical arrangement in raising for having the widest load flexibility in the water/steam profile control from 5-10% to 100% load. Furthermore, the horizontal arrangement offers to the project engineer the widest degrees of freedom for obtaining a good heat exchange efficiency per sqm of surface. For example various fume rates through the tube banks can be arranged, by modifying the pitch and the tube length, and the water/steam rate by adjusting the tube diameter, without restrictions due to particular fluid-dynamic requirements to be observed inside the tubes. A still more preferred arrangement of the steam generator of the invention is achieved when the hot fumes are under pressure and thus the exchange must take place with fumes contained within a pressure vessel.

As step e) is concerned, that is the maintaining, in all the pressure conditions of the produced steam, of a first part, or all, of the steam generator in supercritical pressure conditions followed by lamination when the fluid enthalpy allows downstream of the lamination the direct transfer of the supercritical fluid to steam phase without crossing the water/steam two-phase fluid area (FIG. 7D), it is to be noted that step e) is optionally used for the ordinary operation of the steam generator, that is for loads higher than 5-10%. It has been surprisingly and unexpectedly found by the Applicant that the procedure of step e), with a final lamination instead of an intermediate one, can preferably be used also in the start-up phase of the steam generator, just after the first warm up with dry tubes. With reference to FIG. 15 the start up is carried out so as to maintain the conditions at the outlet of the steam generator outside the evaporation area (two-phase mixture zone) by selecting the operating pressure so that in a first phase the water outletting the steam generator is undercooled (below the saturation temperature at the operating pressure) and, after passing the evaporation zone in the supercritical pressure zone, the steam is superheated (above the saturation temperature at the operating pressure). In the initial phases water is laminated and conveyed to a flash tank. When the water at the outlet of the steam generator head has an enthalpy of about 150 kJ/kg higher than the saturated steam enthalpy (at the admission pressure into the turbine), it is injected in the startup circuit of the turbine.

In particular it has been surprisingly and unexpectedly found by the Applicant that the modalities of step e) can be preferably used also in the start up phase of the steam generator. In fact a particularly rapid and highly desired procedure from an industrial point of view has been found out. The start up procedure comprises the following process steps:

- initial heating of dry tubes, that is without water, of all the branches,
- feeding of the tubes of only one branch with water under supercritical pressure, preferably 240-280 bar, heating with hot fumes and lamination when the water at the outlet of the steam generator head has an enthalpy of about 150 kJ/kg, higher than the saturated steam enthalpy (i.e. above the steam line, that is outside the evaporation area 157 of FIG. 16) at the inlet pressure of the turbine, or by heating the fluid so that lamination produces always and only superheated steam (FIG. 16); that is the superheated steam is outside the water/steam two-phase zone of the evaporation area 157 of FIG. 16), once a load condition equal to 30% of the one used branch is reached, the feedback controls are operated, as described in the steam generator of the invention and capable to set up the temperature profile control scheme for the branch in service.

The advantages of this start-up procedure are the very fast load feeding, the production of only steam, the control of the interval from 0 to 30% load of the branch with a different (from temperature profile control) and yet very simple regulation logic, i.e. with steam temperature controlling the final lamination valve, anticipated set up of the feedback regulation control devices. The profile control conditions are exceptionally fast.

The above mentioned Figures are described more in detail hereinafter.

Figure 6:
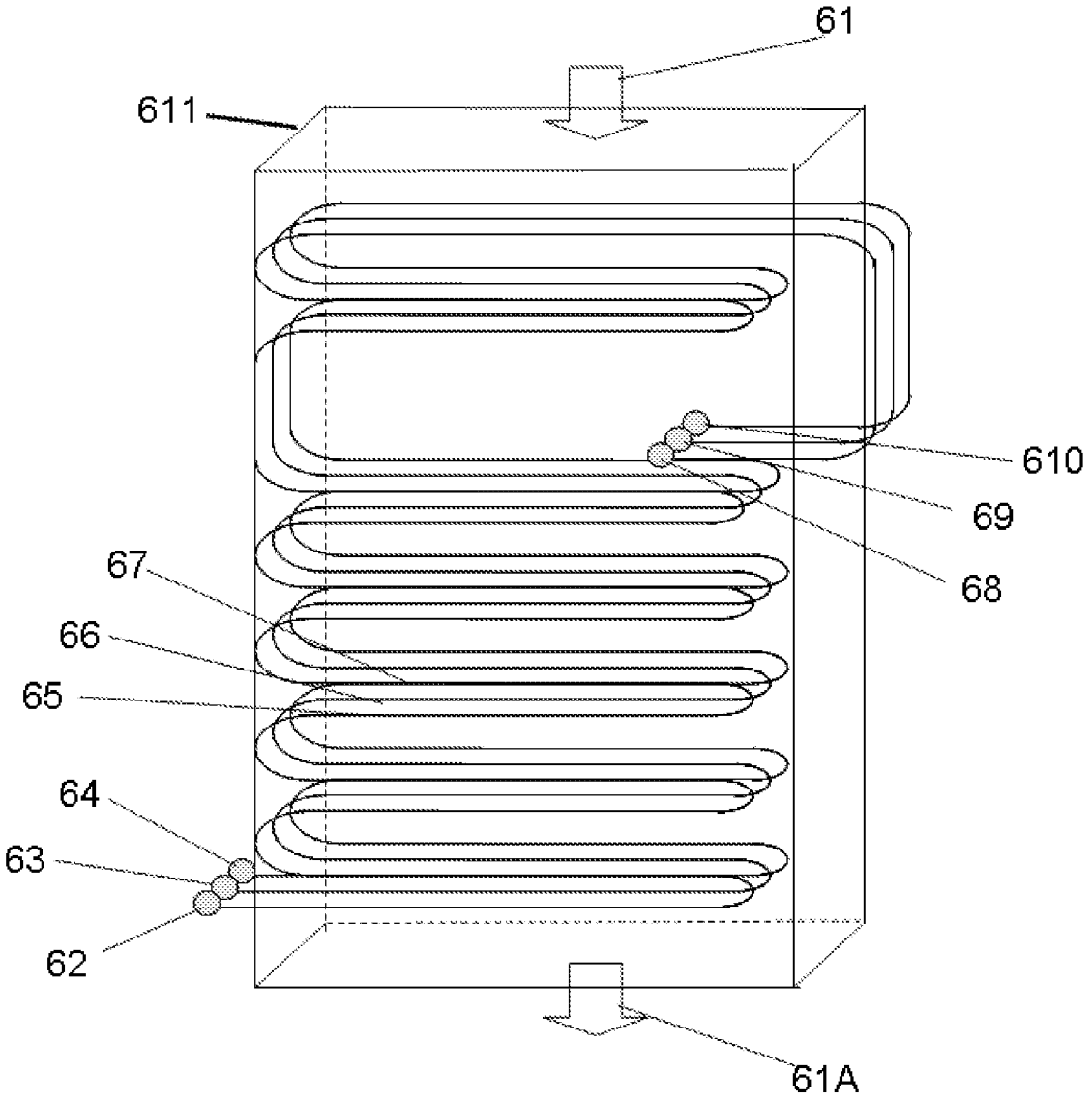

FIG. 6 schematically represents a steam generator according to the invention with pure countercurrent heat exchange with fumes entering from the top and water fed from the bottom.

Figure 7A:
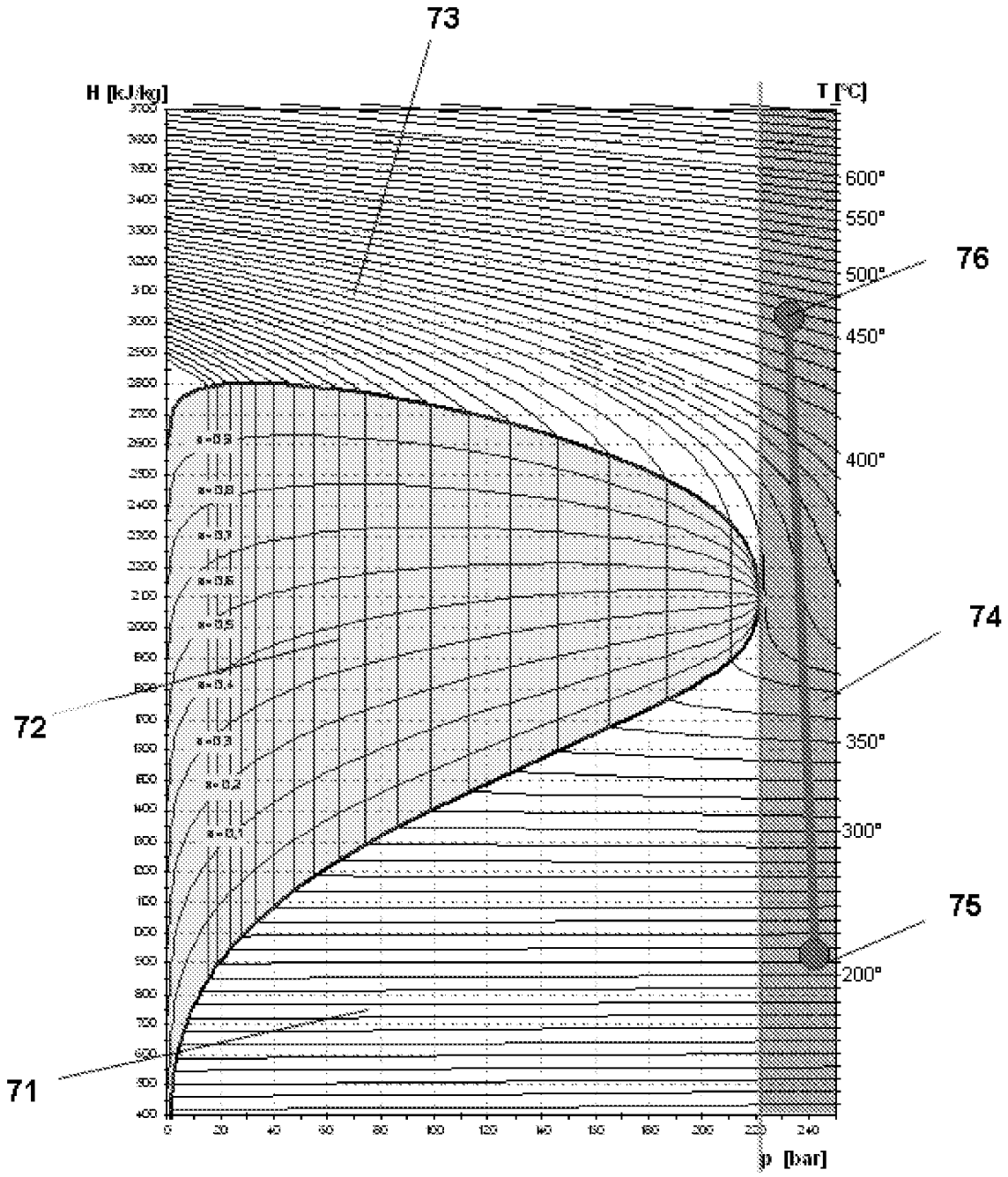

FIG. 7A is a diagram pressure-temperature-enthalpy showing the heating in supercritical conditions of the water/steam fluid at a 100% load.

Figure 7B:
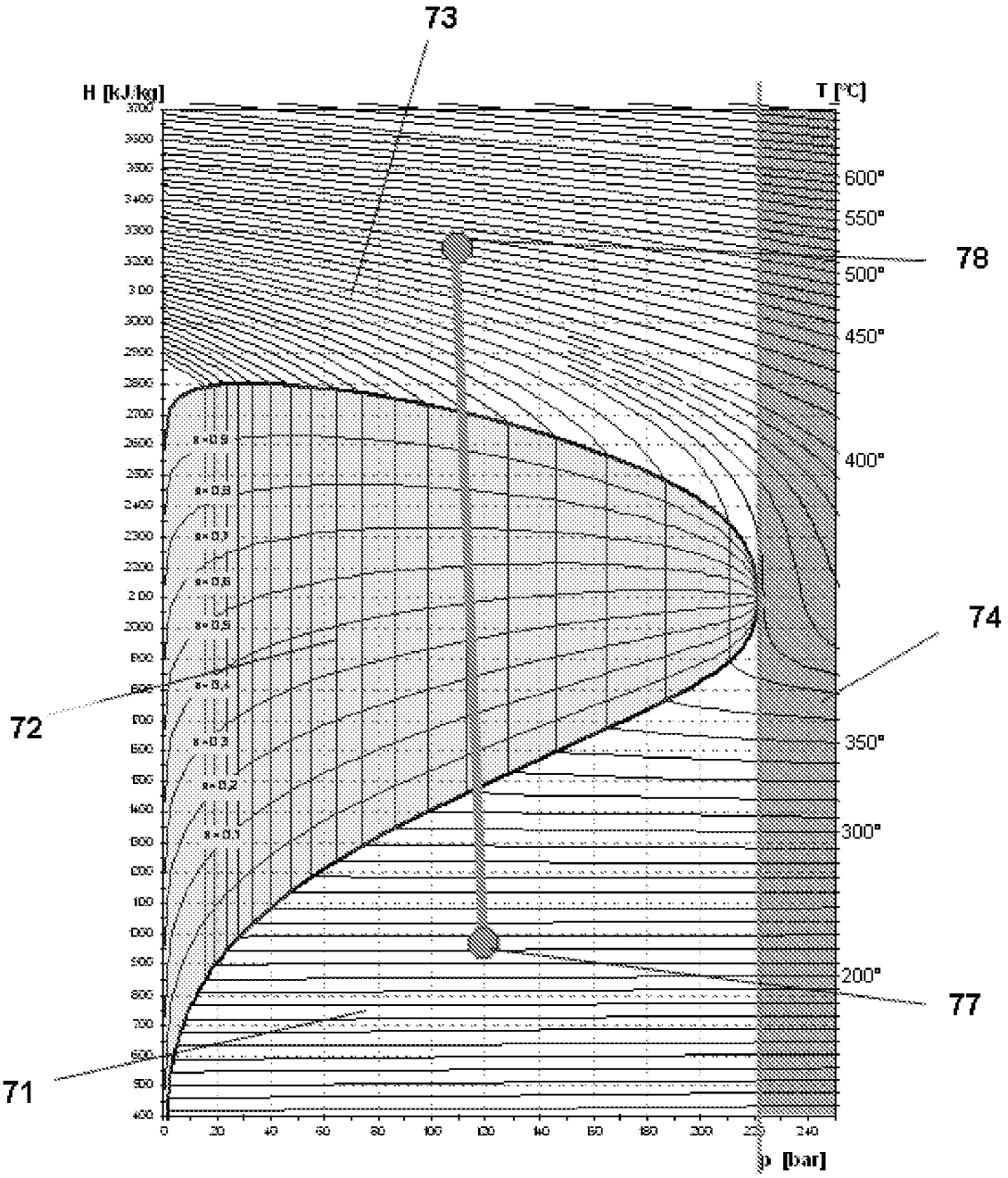

FIG. 7B shows in a diagram pressure-temperature-enthalpy the heating in subcritical conditions of the water/steam fluid at a 50% load, representative for the partial loads of a steam generator.

Figure 7C:
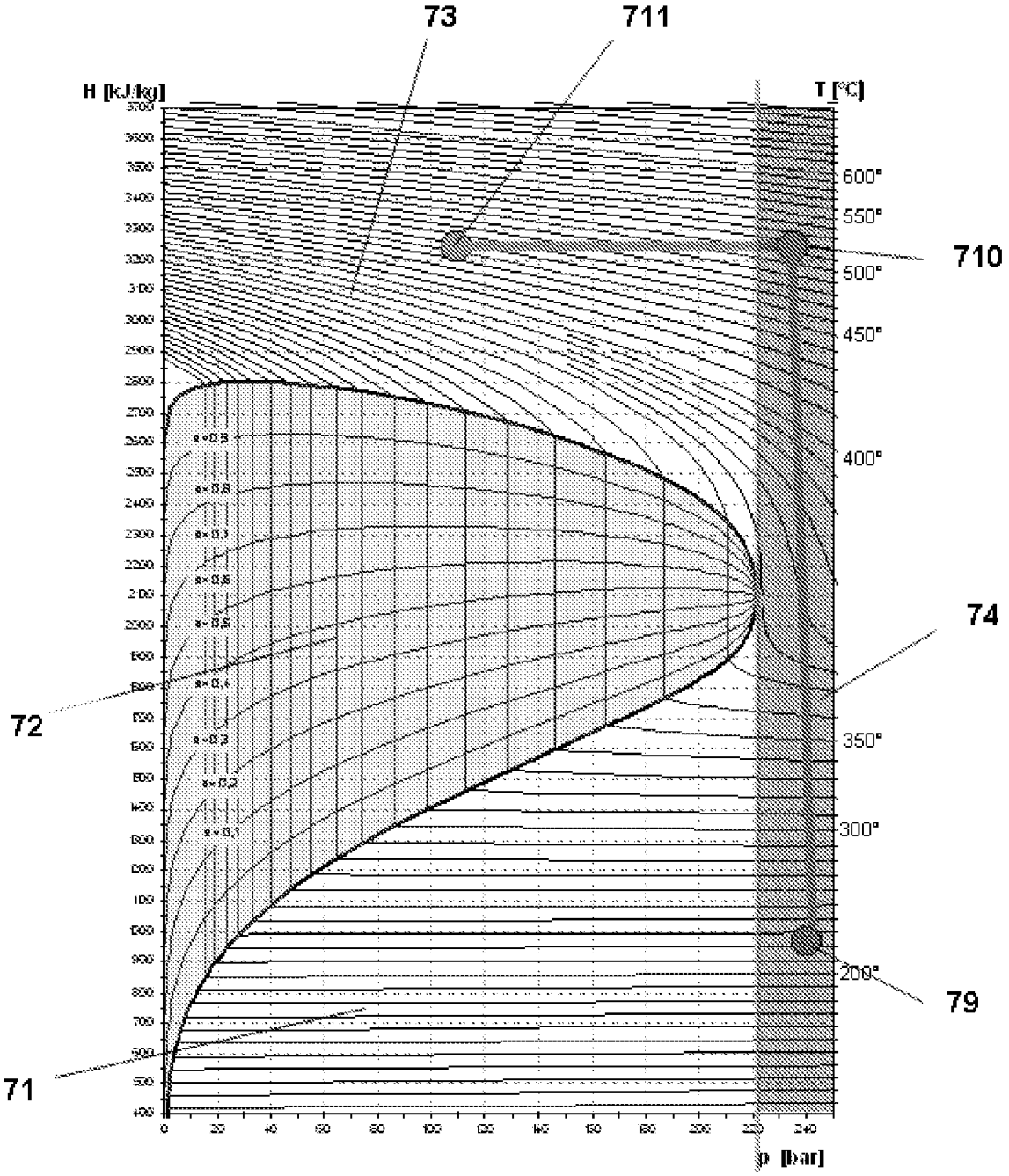

FIG. 7C shows in a diagram pressure-temperature-enthalpy the heating in supercritical conditions of the water/steam fluid at a 50% load (representative for the partial loads of a steam generator), and the subsequent lamination at the steam turbine inlet.

Figure 7D:
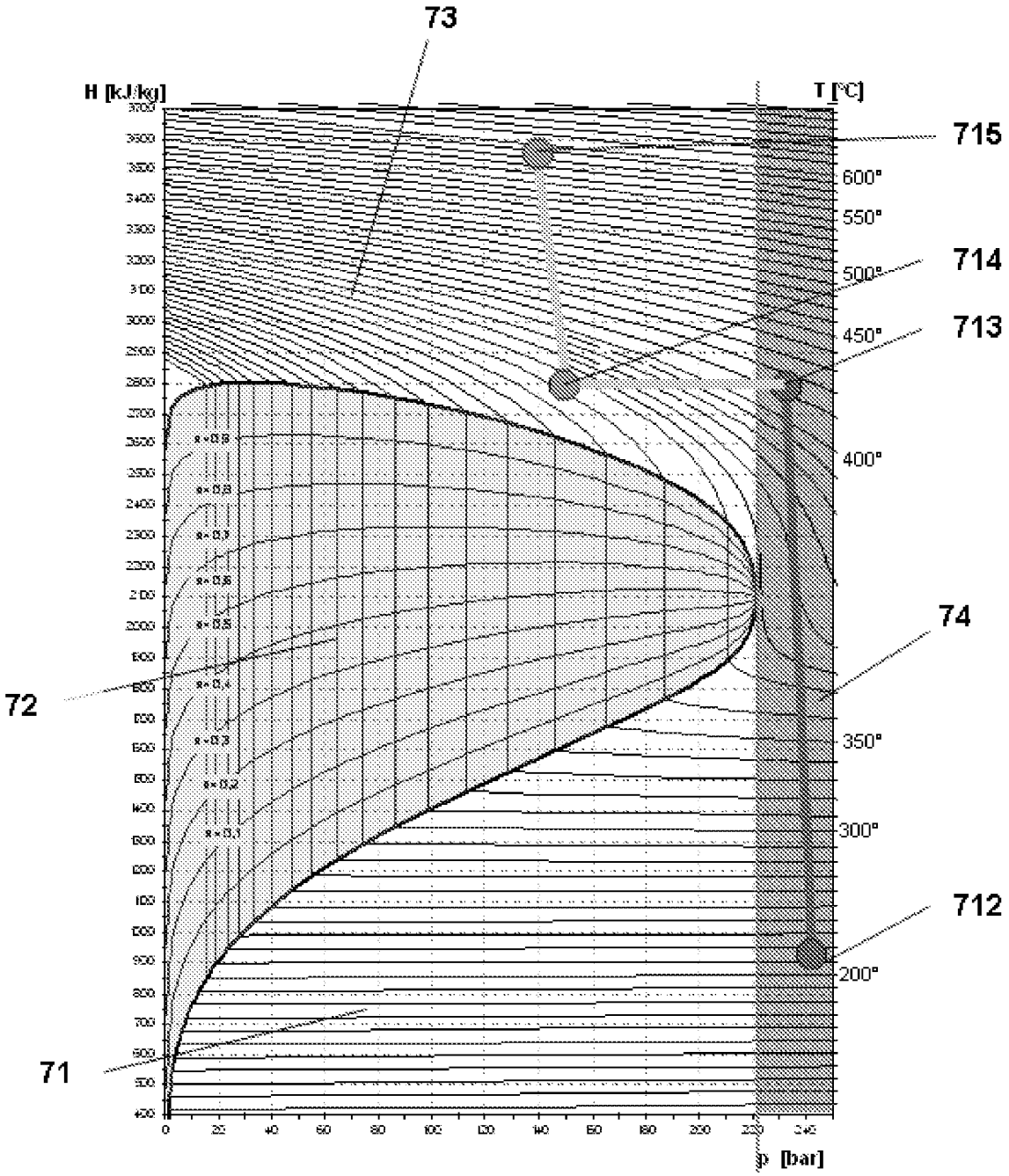

FIG. 7D shows in a diagram pressure-temperature-enthalpy the heating in supercritical conditions of the water/steam fluid, the subsequent pressure decrease by lamination of the fluid itself without formation of bi-phase water/steam mixture, and superheating of the subcritical steam.

Figure 8:
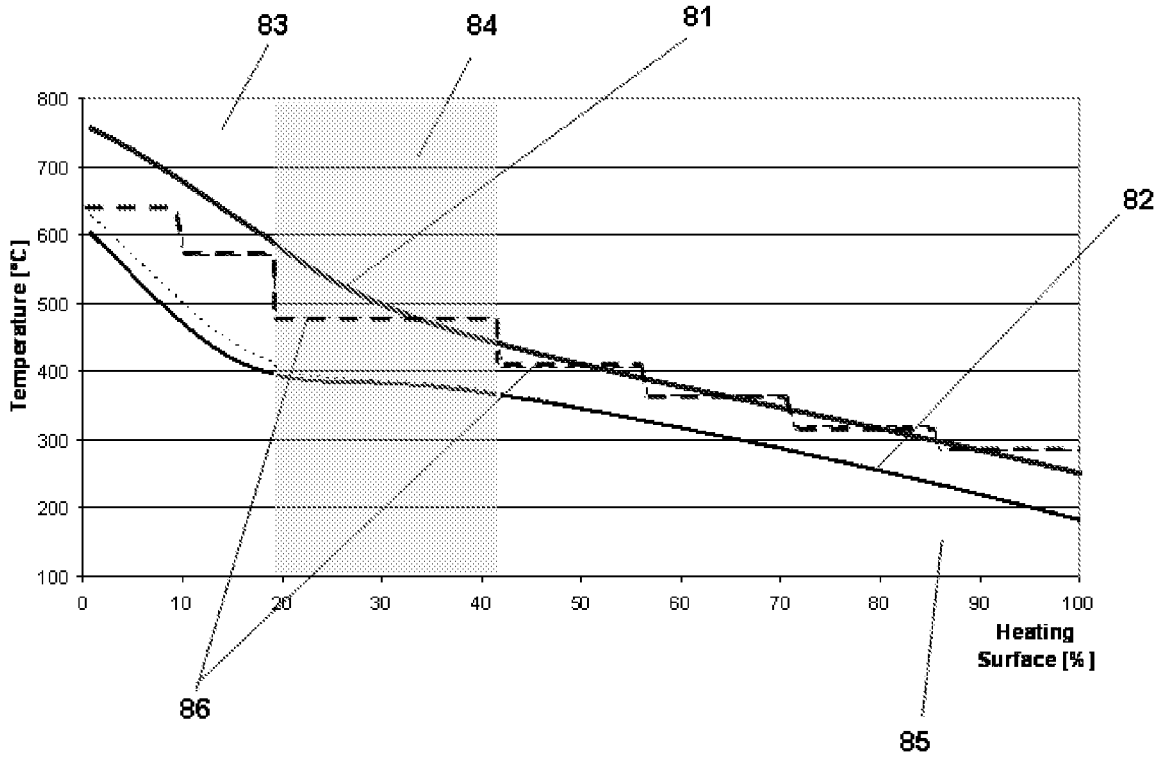

FIG. 8 represents a plot of the temperature of: the fumes, the water/steam fluid at a 100% load as a function of the heat exchange surface of the steam generator.

Figure 9:
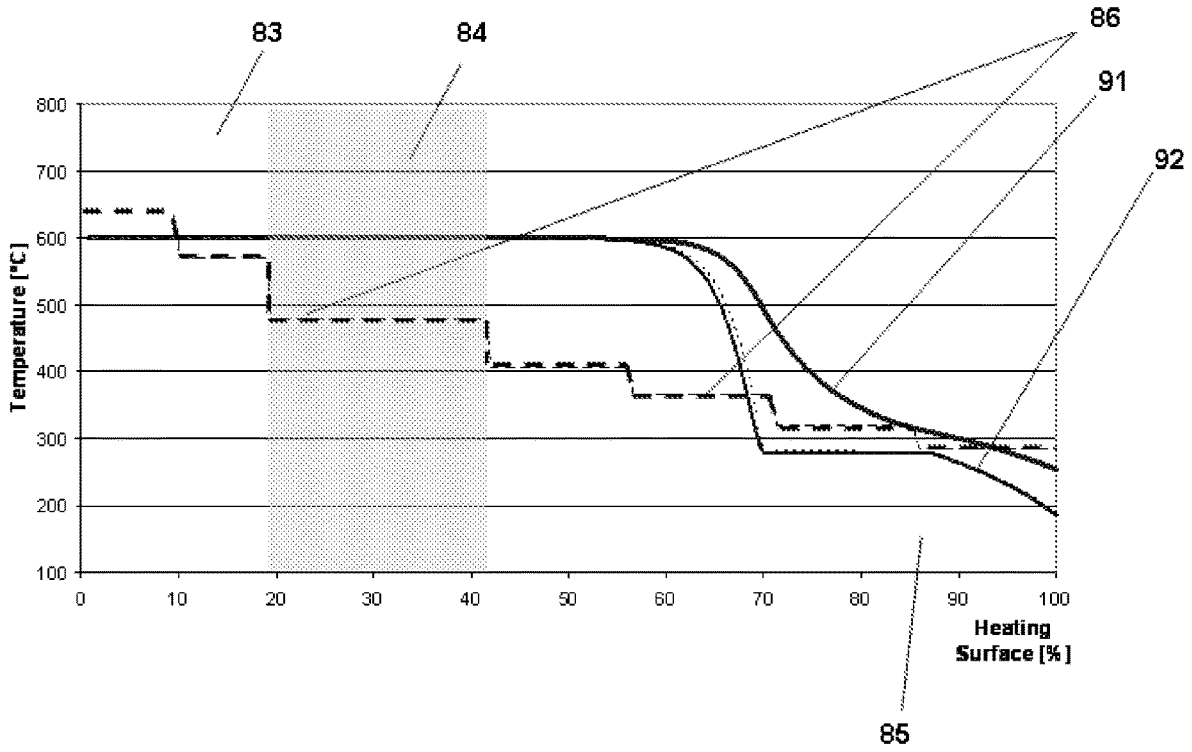

FIG. 9 comparative, it represents a plot of the temperature of: the fumes, the water/steam fluid as a function of the heat exchange surface at a reduced load in the case of the prior art without choking and partial exclusion of the heat exchange surface.

Figure 10:
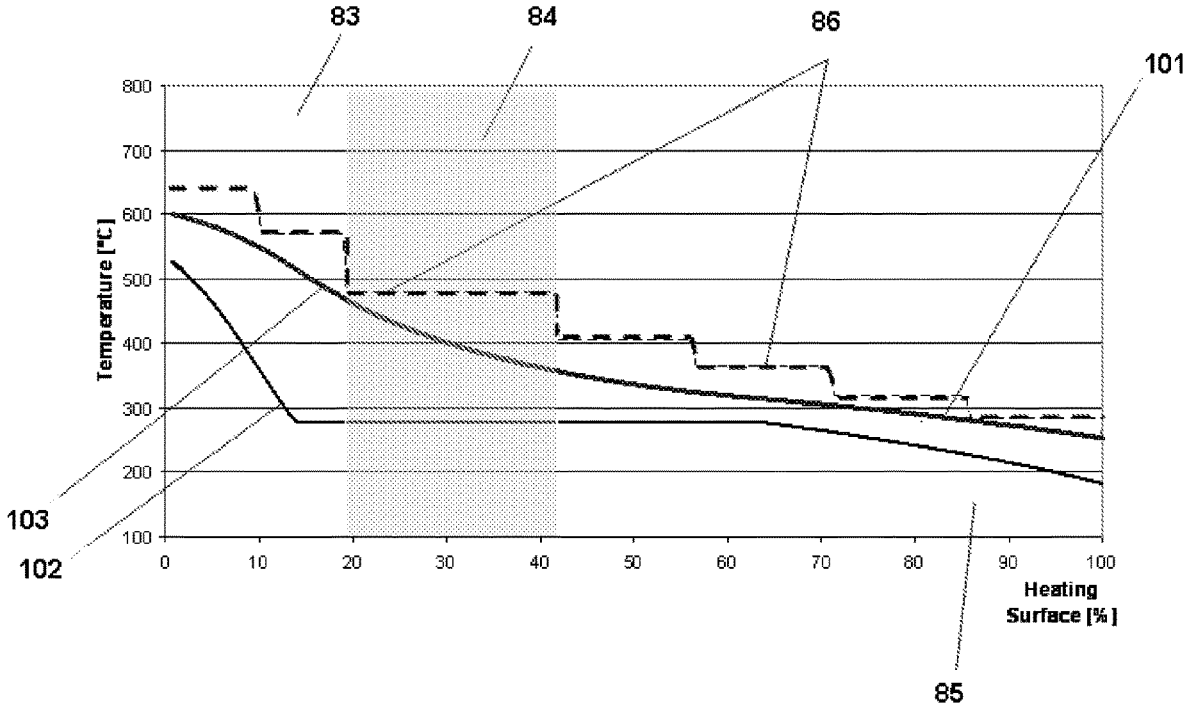

FIG. 10 shows a plot in a steam generator of the invention of the temperature of: the fumes and the water/steam fluid at a 100% load as a function of the heat exchange surface at a reduced load with surface tri-partition choking and with one branch in service only.

Figure 11:
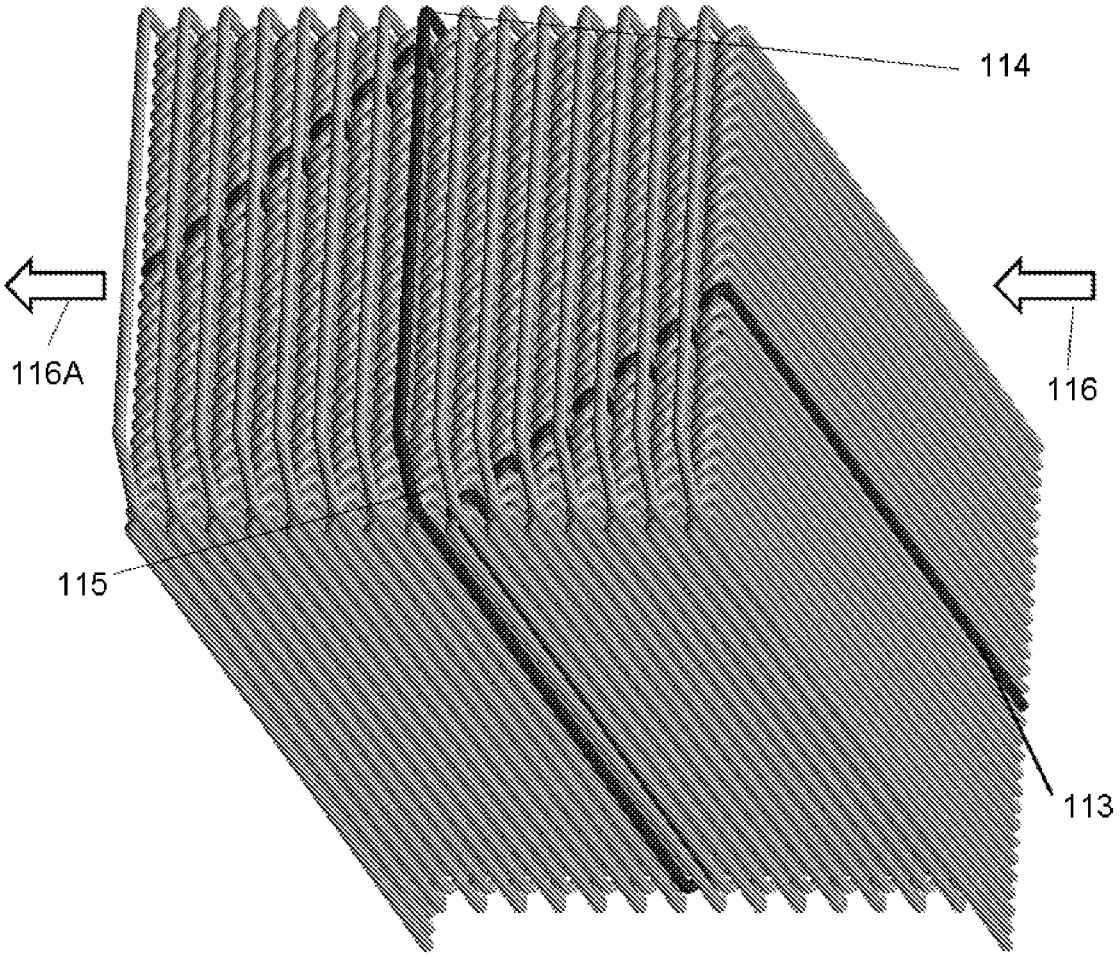

FIG. 11 is a perspective view showing the course of the tubes in an horizontal steam generator according to the present invention.

Figure 12:
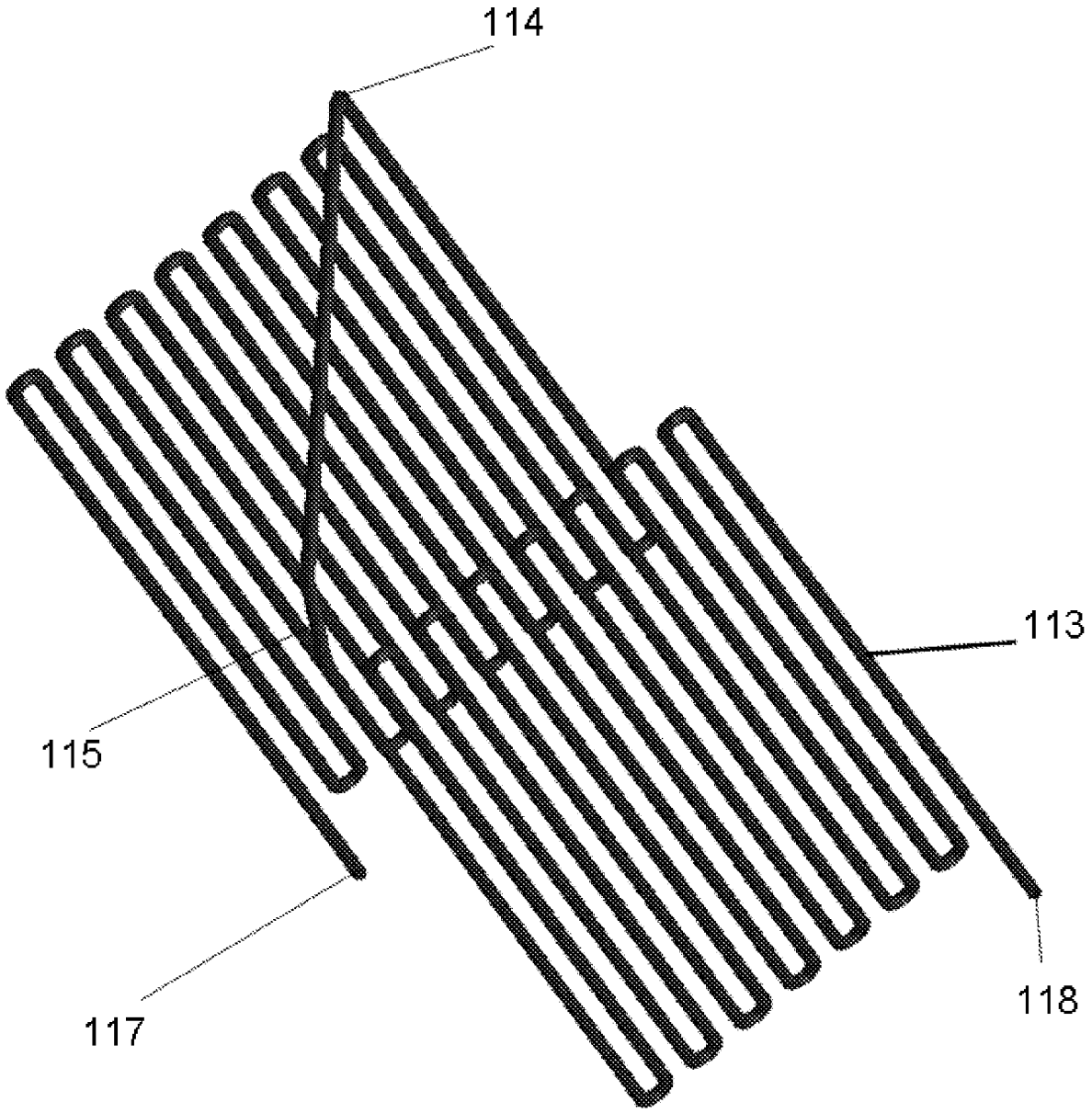

FIG. 12 shows the course of a tube in an horizontal steam generator according to the invention.

Figure 13:
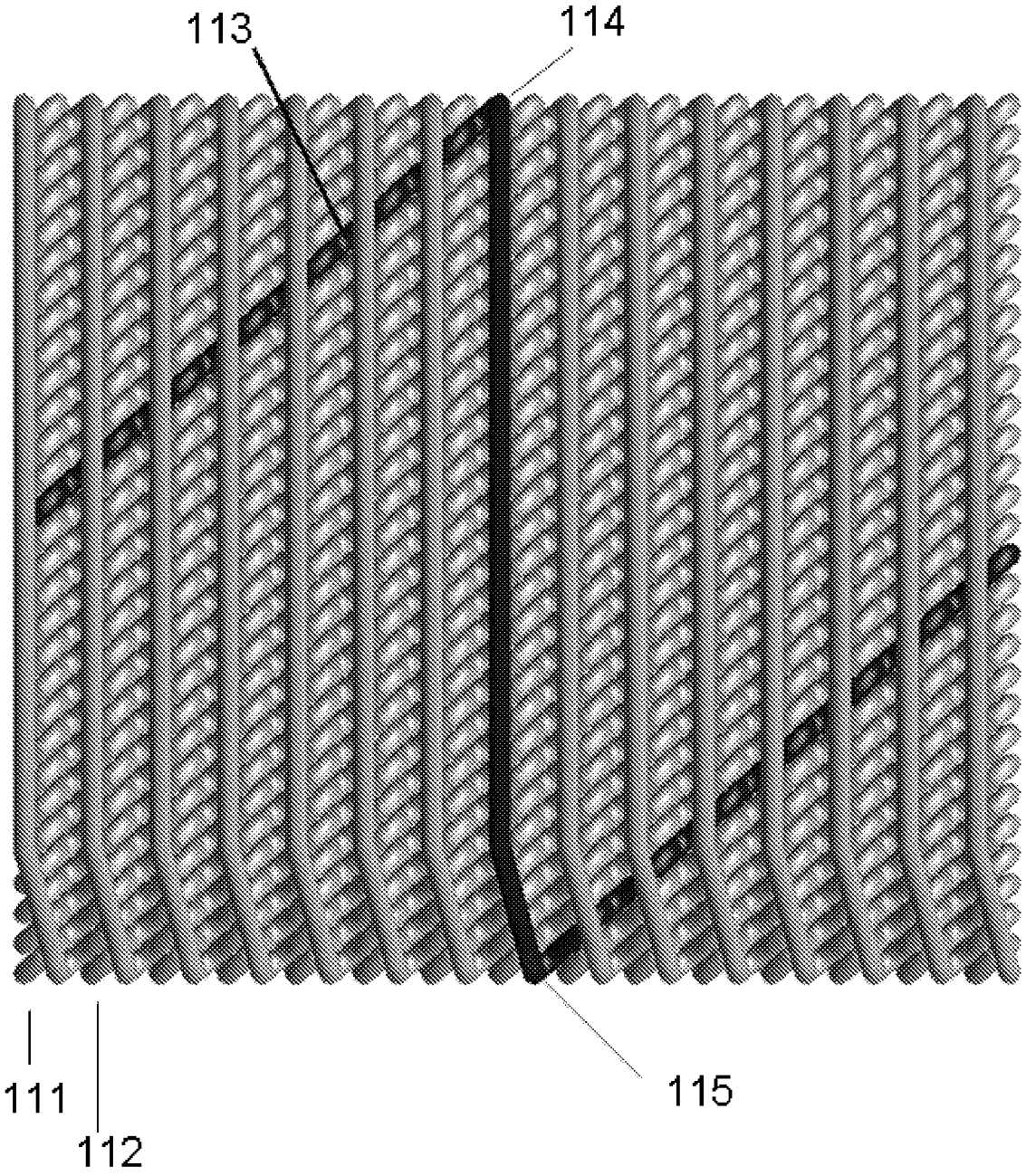

FIG. 13 is a front view of the steam generator of FIG. 11.

Figure 14:
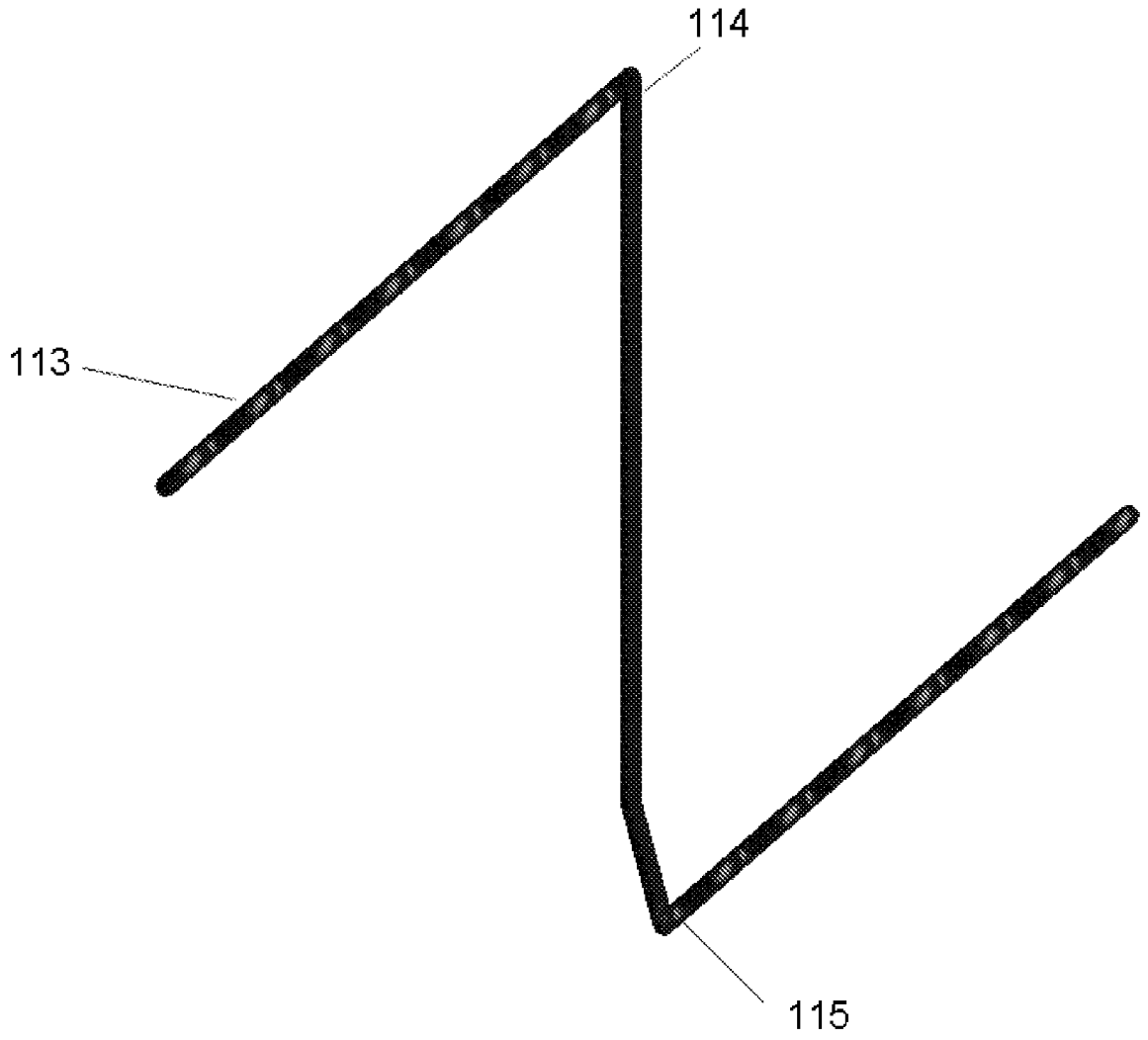

FIG. 14 is a front view of the tube of FIG. 12.

Figure 15:
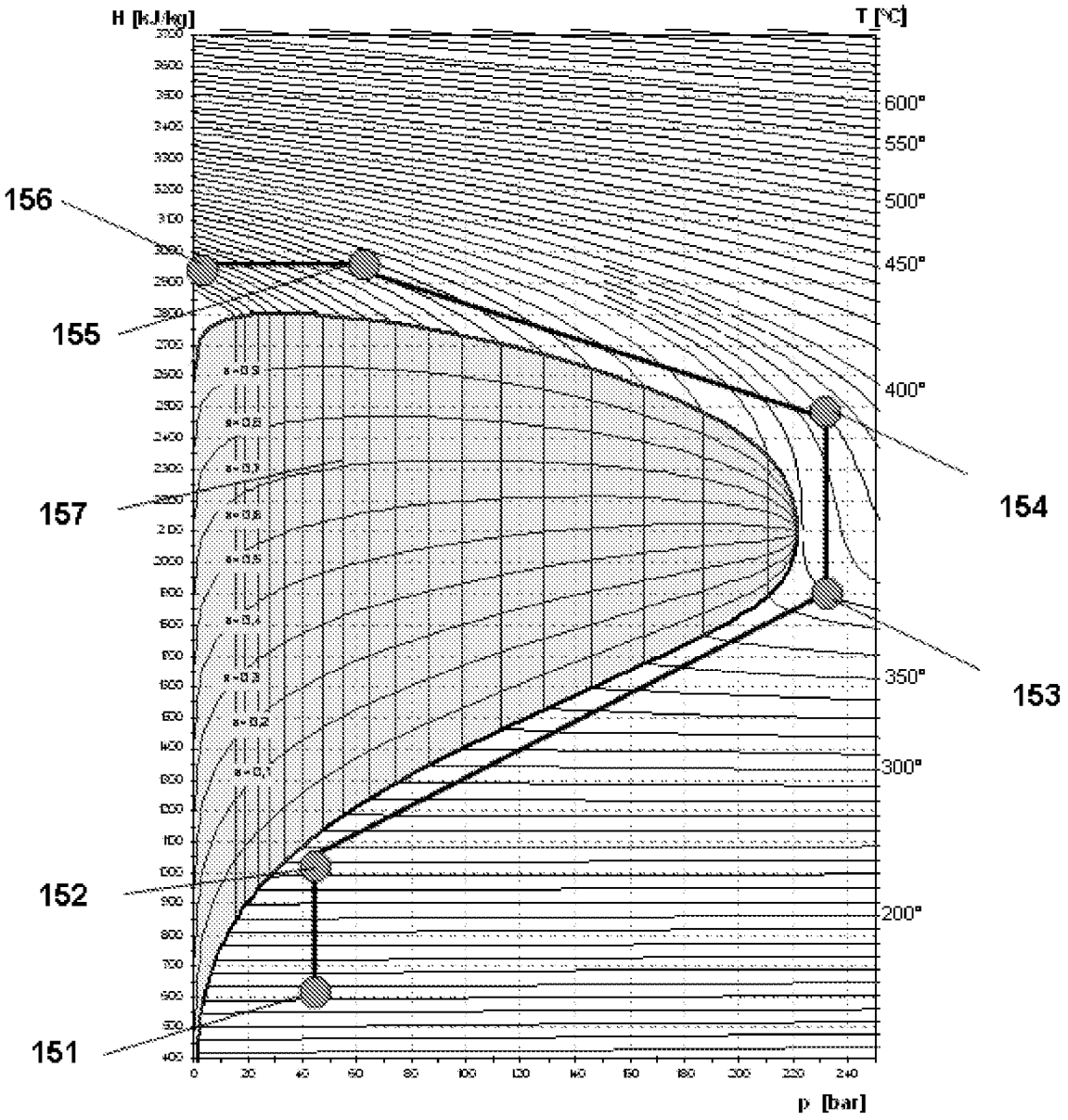

FIG. 15 shows in a diagram pressure-temperature-enthalpy the start up zone of the steam generator of the invention with fluid at the steam generator outlet in single-phase conditions.

Figure 16:
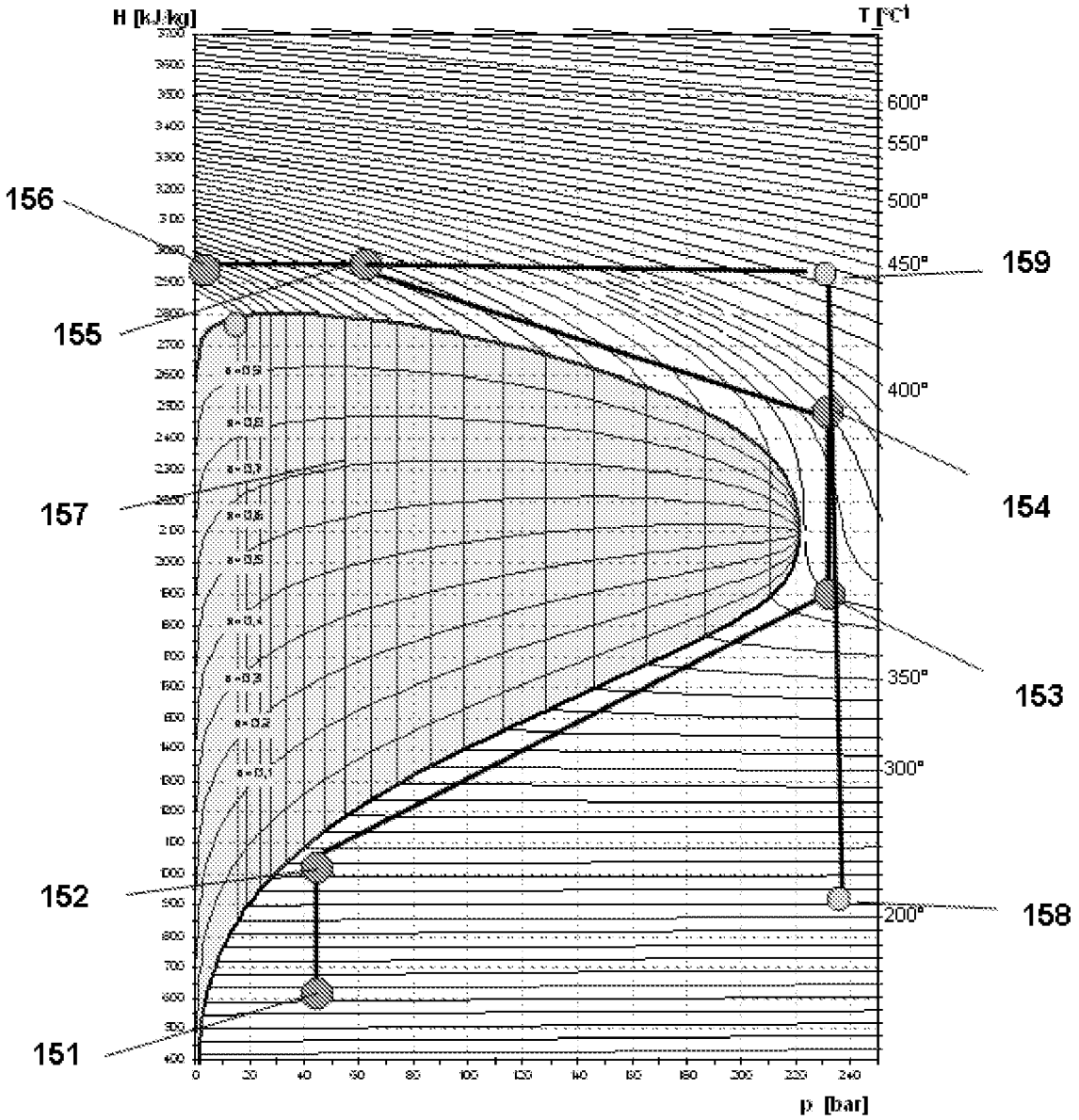

FIG. 16 shows in a diagram pressure-temperature-enthalpy the preferred start up method of the steam generator of the invention by maintaining the fluid always in supercritical conditions and fluid lamination at an enthalpy value such as to obtain only steam in conditions for admission into the turbine.

The following Figures are described in detail.

Figure 1:
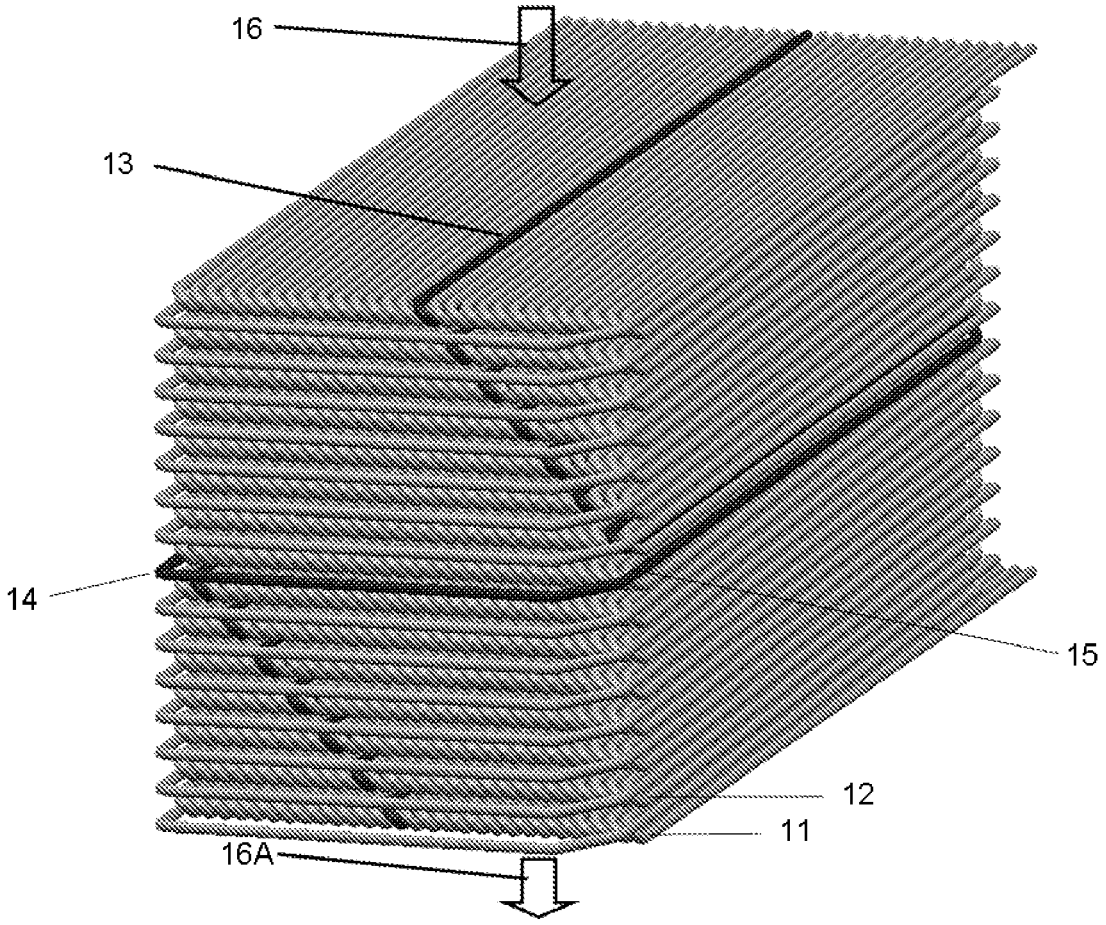
FIG. 1 is a perspective view from the top of the tube course in a vertical steam generator of the invention.

FIG. 1 is a tridimensional picture of tube banks (2) of a vertically arranged steam generator of the invention, with water feeding from the bottom and fumes 16 entering from the top (fume outlet 16A). The single exchange tubes, see for example tube 13, by turning after an horizontal rectilinear part, not only shift from a plane to the upper one, for example from the plane 11 to the upper plane 12 of the figure, but at once they also shift laterally towards the left. Once arrived to the limit of the fumes containing vessel (not shown in the figure) at the extreme left of the Figure, the tube at position 14 turns and, crossing the tube bank, takes the place 15, at the right end of the vessel.

Figure 2:
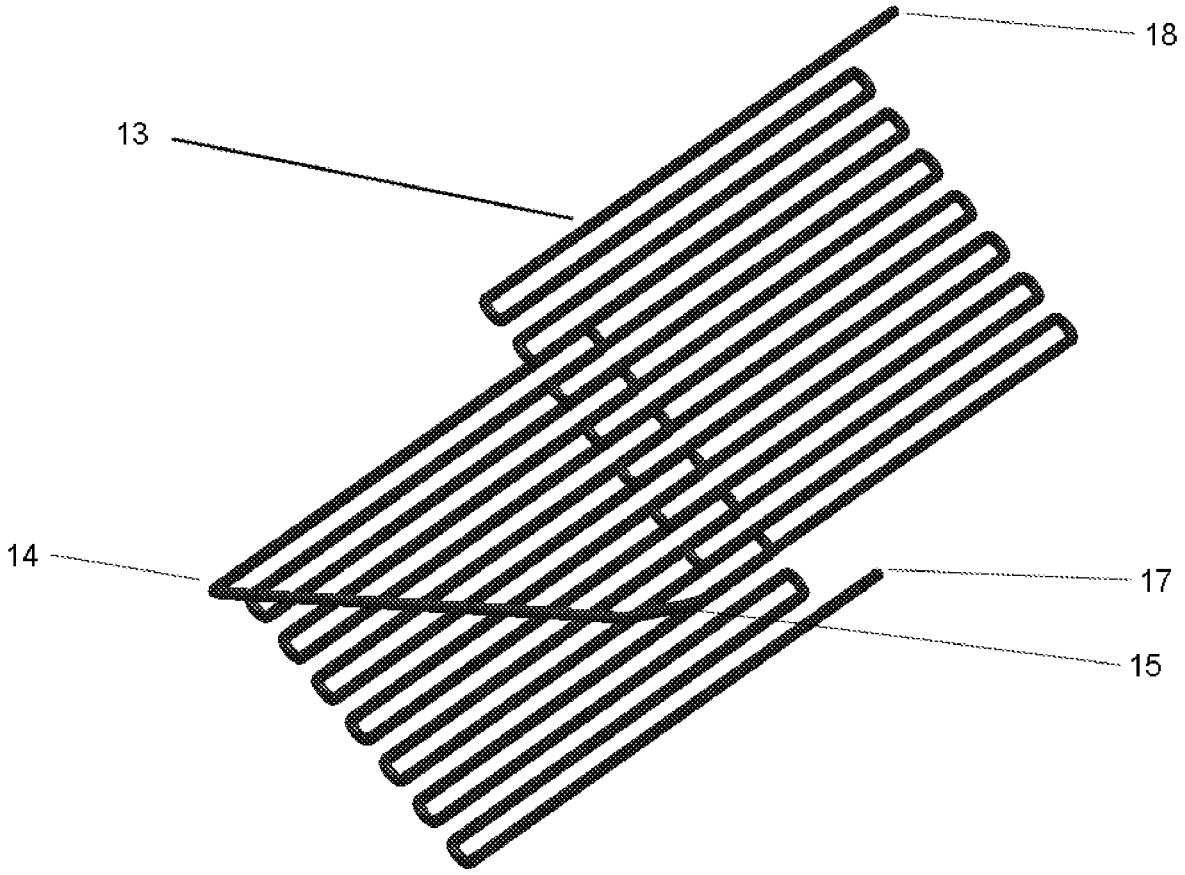
FIG. 2 represents the course of a tube in a vertical steam generator of the invention.

FIG. 2 represents an extract of FIG. 1 wherein only tube 13 is represented. 17 is the water inlet in the lower part of the tube bank and 18 represents the outlet of the fluid in the upper part of the tube bank.

Figure 3:
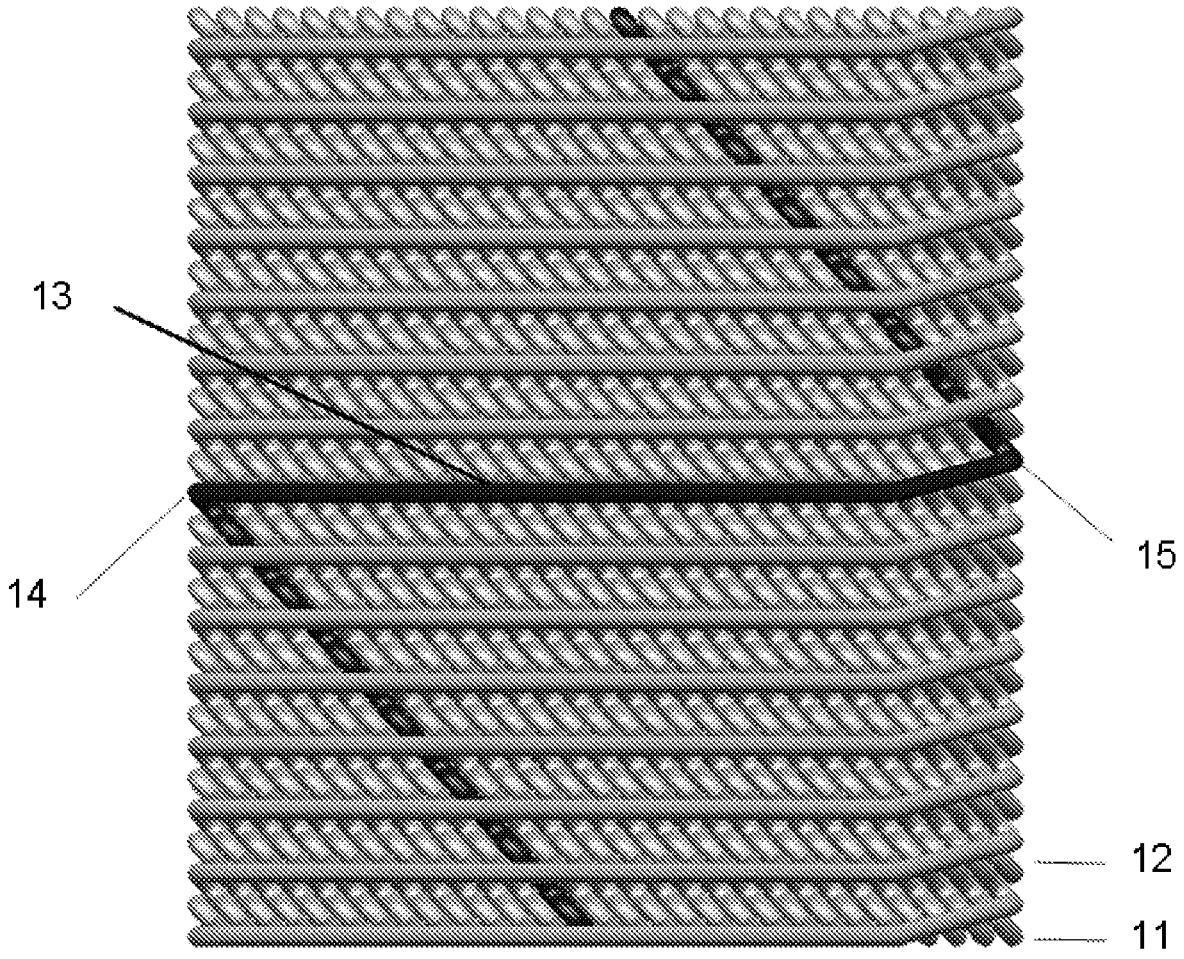
FIG. 3 is a front view of the steam generator of FIG. 1.

FIG. 3 shows a front view of a tube bank of a vertical steam generator with water feeding from the bottom already described in FIG. 1. The single heat exchange tube, for example tube 13, by turning, not only it shifts from a plane to the upper one (for example from plane 11 to the upper plane 12), but it also shift laterally towards the left (FIG. 2). Once arrived to the limit of the fume containing vessel (not shown in the figure) at the extreme left of the Figure, the tubes turn at position 14 and, crossing the tube bank, insert at position 15, at the right end of the vessel.

Figure 4:
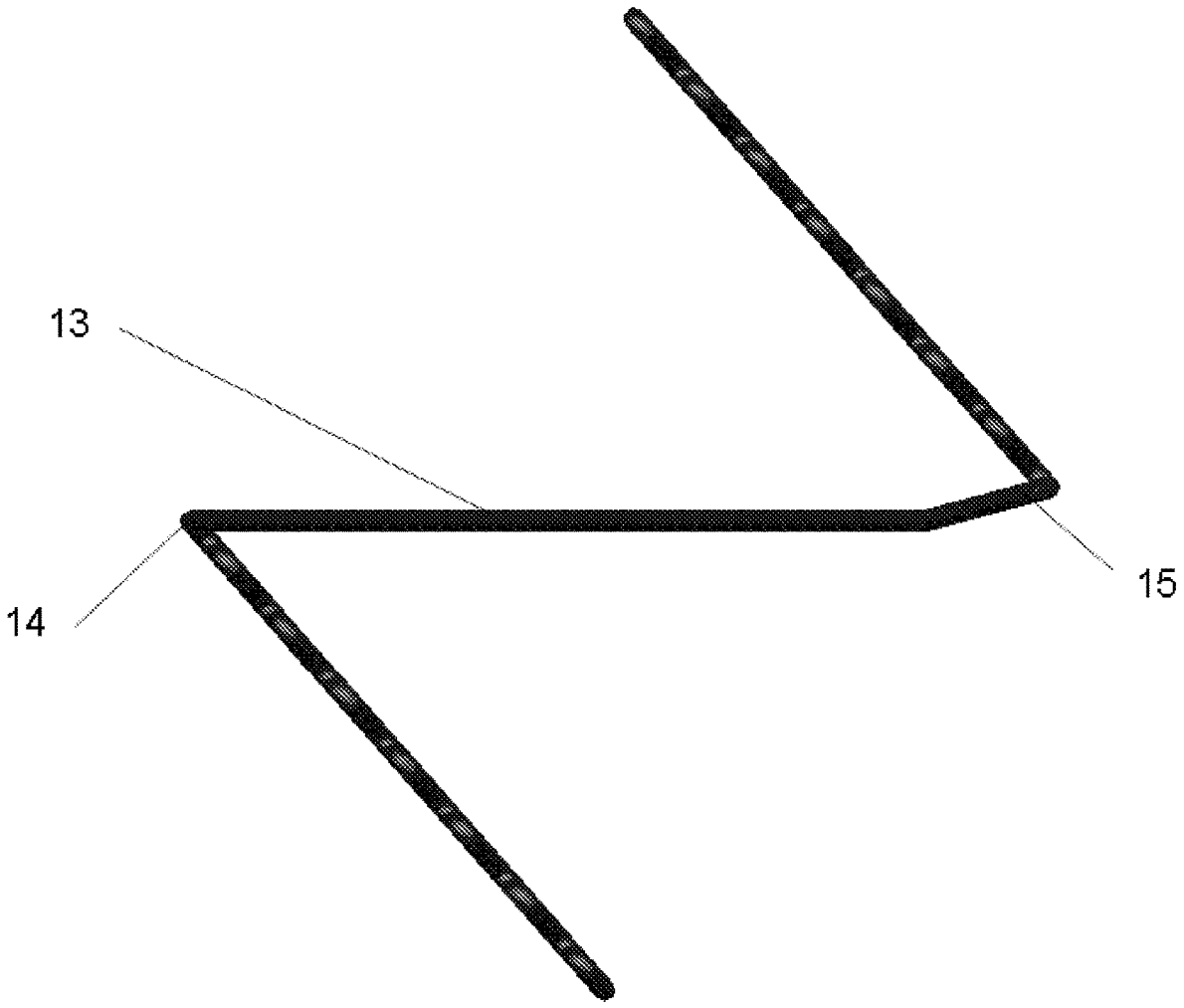
FIG. 4 is a front view of the tube of FIG. 2.

FIG. 4 shows, in the same front view of FIG. 3, only tube 13 isolated from the remaining part of the tube bank, as described in FIG. 1 and FIG. 2. The heat exchange tube by turning, shifts from a plane to the upper one and also laterally to the left. Once arrived to the limit of the fume containing vessel (not shown in the figure) at the extreme left of the Figure, the tube turns at position 14 and, by crossing the tube bank, takes position 15, at the right end of the vessel.

Figure 5:
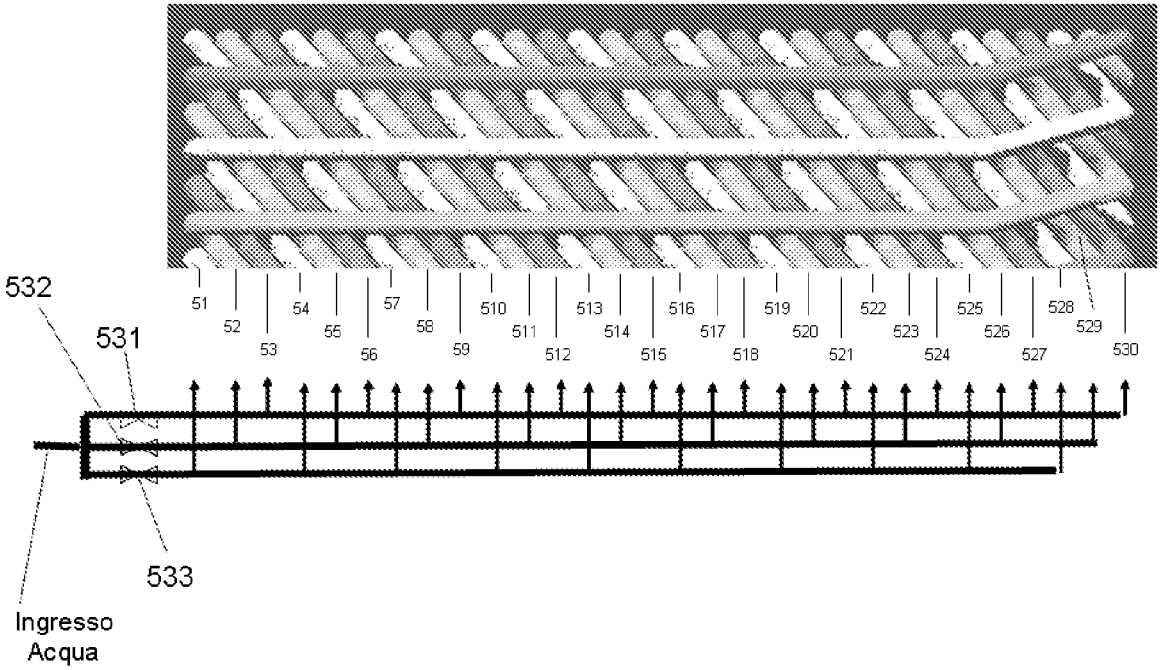
FIG. 5 shows the independent branches feeding in an embodiment of the steam generator of the invention. In the case exemplified in the Figure three independent circuits are shown.

FIG. 5 shows one tube bank of the type described in FIG. 1, in a front view as in FIG. 3, formed of 30 tubes in the horizontal plane. The 30 tubes are alternately fed by three separate headers through the opening of valves 531, 532, 533. There are therefore three separate circuits, each formed of 10 tubes (fed in parallel). The tubes 51, 54, 57, 510, 513, 516, 519, 522, 525, 528, wherein passes water/steam when valve 531 is open, belong to the first circuit. In the second circuit there are tubes 52, 55, 58, 511, 514, 517, 520, 523, 526, 529, fluxed water/steam when the valve 532 is open. In the third circuit there are, of the remainder branch, tubes 53, 56, 59, 512, 515, 518, 521, 524, 527, 530 with the related valve 533 that regulates the flow thereof with water/steam. In the figure there is a schematic representation of the separate feeding system for each circuit, with the flow metering valves of each circuit. As an example, with the valve 531 open and the valves 532 and 533 closed, only in the tubes of the first circuit (tubes 51, 54, 57, 510, 513, 516, 519, 522, 525, 528) there is water/steam flow. With the tubes of the different circuits assembled together and arranged for the oblique tube bank rise, there is an uniform absorption of heat flux in the various circuits when all the circuits are fed. When one or more branches are without feeding, the temperatures reached by their tubes are limited to the average fumes temperature, by the near tubes of the circuits in operation (one or more). In fact the fed circuits locally keep fumes, which come into contact also with the tubes of the non operating circuits, at the optimal design temperature profile. FIG. 6 represents one type of steam generator of the invention with vertical arrangement, with fumes 61 entering from the top (and outlet 61A) and water entering from the bottom (through the headers 62, 63, 64). The heat exchange scheme is that of pure countercurrent. Therefore three separate circuits 65, 66, 67 are represented, each set up with one inlet header (in the Figure, header 62 feeds circuit 65, header 63 circuit 66, header 64 feeds circuit 67), heat exchange tubes (in the Figure it is reported one heat exchange tube for a circuit) and steam outlet headers (in the Figure header 68 for steam extraction from circuit 65, header 69 for circuit 66, header 610 for circuit 67). Headers 68, 69, 610 can be positioned both outside the fumes containing vessel 611, (option not reported in the figure), and in the fumes themselves in a position wherein the fumes temperature is near that of steam (preferred option, shown in the figure).

It is noticeable that tubes are uninterrupted, from the inlet headers to the outlet headers. Alternatively, (embodiment not shown in the figure), intermediate headers can be made available (suitably positioned before and/or after the evaporation or pseudo evaporation zone). Alternatively, (embodiment not shown in the figure), re-heating stages of intermediate pressure steam spilled from the turbine, or more steam re-heating stages at a different pressure, can be made available. Alternatively, (embodiment not shown in the figure), de-superheating stages can be arranged.

FIG. 7A represents, in a diagram pressure-temperature-enthalpy for water in supercritical conditions, the heating pathway from water at high density (water-like) to a fluid at lower density (steam-like), called superheated supercritical steam, at a 100% load. This transition takes place in one of the steam generator embodiments of the invention. In the diagram, four zones (or regions) can be identified, indicated in the figure with 71, 72, 73 and 74. Zone 71 represents the sub-cooled water; it is represented by the tract below the evaporation area (zone 72), when the pressure is lower than the critical pressure (around 221 bar). Zone 72, called evaporation zone, is the region, for a pressure below critical value, wherein liquid water and steam are both present. Above zone 72 (always pressures below critical pressure) only steam (zone 73) is present. Zone 74 comprises water in conditions above the critical pressure. Water at low enthalpy and high density (water like) in the conditions represented by point 75, undergoes a pseudo evaporation (state transition in the absence of formation of the liquid/steam mixture) represented by the points of the line comprised between points 75 and 76. At point 76 water has high enthalpy and low density (steam like), so that to be fed to the turbine.

FIG. 7B represents, in a diagram pressure-temperature-enthalpy for water, the heating from sub-cooled water at subcritical conditions to superheated subcritical pressure steam at a 50% load (partial load). This transition takes place in one of the steam generator embodiments of the invention, being the load variation operated in sliding pressure modality. In the diagram four zones (or regions), indicated in the figure with 71, 72, 73 and 74 and described in FIG. 7A, are shown. The sub-cooled water at the conditions represented by point 77, undergoes the evaporation (state transition by formation of the liquid/steam mixtures) represented by the points of the line comprised between points 77 and 78. In 78 the superheated steam at subcritical pressure is in the conditions for feeding the turbine.

FIG. 7C represents, in a diagram pressure-temperature-enthalpy for water, the heating from sub-cooled water at supercritical condition to superheated supercritical steam at a 50% load (partial load). This transition takes place in one of the steam generator embodiments of the invention operated in constant pressure modality. In the diagram, four zones (or regions) are shown, indicated in the figure with 71, 72, 73 and 74 and described in FIG. 7A. The sub-cooled water, in the conditions represented by point 79, undergoes the pseudo evaporation (it corresponds to the above state transition, but without formation of the liquid/steam mixture) represented by the points of the line comprised between points 79 and 710. In 710 the superheated steam, at supercritical pressure, outlets the steam generator and it is laminated (lamination from point 710 to point 711) in order to have in 711 the suitable pressure conditions for admission into the turbine.

FIG. 7D represents, in a diagram pressure-temperature-enthalpy (H-T-p) for water, the heating pathway from water at high density (water like) in supercritical conditions to a fluid at lower density (steam like), called superheated subcritical steam, and the successive pressure decrease by lamination of the steam without formation of a water/steam two-phase mixture. These transitions (heating and lamination) take place in one of the steam generator embodiments of the invention. In the diagram four zones are shown, indicated in the figure with 71, 72, 73 and 74 and described in FIG. 7A. The low enthalpy and high density water (water like) in the conditions represented in point 712, undergoes the pseudo evaporation (state transition without formation of the liquid/steam mixture) represented by the tract comprised between points 712 and 713. In 713 the water has high enthalpy and low density (steam like). Through lamination (transition represented by the points comprised between 713 and 714, through one or more valves, the water pressure is decreased without having the liquid/steam mixture formation typical of zone 72, but belonging to zone 73 of superheated steam. The transformation represented by the tract between 714 and 715 is the superheating of subcritical steam, taking place in the terminal part (terminal part along the water/steam path) of the steam generator.

In FIG. 8 it is shown, at 100% of the steam generator load and at supercritical conditions of the water/steam fluid, the plot of the temperature of: the fume (curve 81) and of the water/steam (curve 82), as a function of the heat exchange surface. In the figure, three zones are represented: the first one, from the left, includes the heat exchange surface wherein the fluid superheating takes place (zone 83). Zone 84 is the heat exchange surface wherein pseudo evaporation takes place. Zone 85 represents the zone wherein there is the heat exchange surface for the fluid preheating (ECO). The "straight-broken" curve 86 is the envelope of the design temperatures of the various sections of the heat exchange surface of the steam generator.

In FIG. 9 it is represented, at a partial load (about 10% of the maximum load) of the steam generator in sub-critical conditions, the plot of the temperature of: the fumes (curve 91) and of the water/steam (curve 92) as a function of the exchange surface. The steam generator is not operated with exchange surface partition by exclusion of branches, as described in FIG. 5. In the figure the three zones (83, 84, 85) described in FIG. 8 are reported. It is noticeable the effect of the heat exchange surface overabundance; it causes, at a partial load, a shift of the EVA zone towards the ECO zone 85, wherein less expensive and less resistant to high temperature materials are used in USC boiler of the art. The "straight-broken" curve 86 is the envelope of the design temperatures, defined for the full load, of the various sections of the heat exchange surface. It is noticeable as well how the water/steam temperature (curve 91) reaches the same values of the fumes temperature (curve 92) for most of the heat exchange surface. Furthermore the water/steam curve 91 approaches and also goes over curve 86 of the design temperatures for materials of the art.

In FIG. 10, at a partial load (about 10% of the maximum load, the same considered in FIG. 9) of the steam generator, in subcritical conditions, a plot, as a function of the heat exchange surface available, of fumes temperatures (curve 101), of the water/steam of the circuit in operation (curve 102), and of the water/steam in the two dry circuits (curve 103) are represented. The steam generator is in fact operated with surface partition by exclusion of some circuits or branches. In the example of the figure there are three circuits (as shown also in FIG. 5), of which only one is fed. In the Figure, the three zones (83, 84, 85) described in FIG. 8 are present. It is worth noticing how the exclusion of a part of the surface (in the example two thirds of the total surface is excluded) causes, also at a partial load, the two-phase transition zone of the running circuit to stay in zone 84, wherein also at full load the pseudo evaporation takes place. In the segmented curve 86, as in FIG. 8, there is the "envelope" of the mechanically admissible (design) temperatures of the various sections of the heat exchange surface. The temperatures of the two excluded (non operative) circuits are close to the fumes temperature, condition shown in the figure by the overlapping of the curves 101 (fumes) and 103 (water/steam in the dry circuits). Both fumes temperatures (curve 101) and those of the water/steam of the three circuits (curves 102 and 103) are lower than the design temperatures of the curve 86. In other words the running circuit keeps the fumes temperature profile in place and protects the non-operative circuits from metal overheating above design temperatures. The fumes temperature plot and the water/steam one is similar to the plot of the same parameters reported in FIG. 8.

FIG. 11 represents, by a tridimensional picture with bottom-up view, the path of the tubes in a tube bank, in the horizontal arrangement. The fumes 116 flow through the tube bank from the right to the left (fume outlet 116A). It is worth noticing that the tubes (for example the black-color tube 113 for better following the path thereof), after an horizontal rectilinear part, end up with curves which shift them in the successive plane, but also towards the upper end of the tube bank. The tubes describe a saw-toothed path.

FIG. 12 represents a particular of FIG. 11, wherein only the tube 113 is represented. The water inlet 117 and the water/steam outlet 118 are shown.

In FIG. 13 a front view of the steam generator described in FIG. 11, is shown. The single heat exchange tube, for example the mentioned tube 113 (black-color to be better evidenced), by bending, not only shift from a plane to the following one (for example from plane 111 to plane 112), but it also shifts towards the upper part of the steam generator. Once arrived to the limit of the fumes containing vessel (not shown in the figure), the tube bends at position 114 and, by crossing the tube bank, takes the opposite position 115, at the lower end of the body.

FIG. 14 shows, in the same front view of FIG. 13, only tube 113 of FIG. 12, blanketing all the other tubes.

FIG. 15 represents, in the diagram H-T-p already described in FIG. 7, the straight-broken curve passing from points 151, 152, 153, 154, 155, 156. The position on the graph of these points is to be intended as an example and not as a precise indication of the limits of the broken curve crossing them. The points of this curve (developed around the evaporation area of the two-phase mixture 157), those to the right of the curve and over points 155 and 156 represent the acceptable conditions of the water/steam outletting the circuit when the steam generator starts-up, as the described start up modality foresees at the steam generator outlet only single-phase fluid.

FIG. 16 represents, in a H-T-p diagram (see FIG. 7) with the start up zones indicated by the segmented curve passing trough points 151, 152, 153, 154, 155, 156 of FIG. 15, one of the preferred start up modality of the steam generator of the invention, by maintaining the fluid always in supercritical conditions up to an enthalpy level, so that fluid lamination produces only steam, with characteristics suitable for direct admission into the turbine. Water in supercritical conditions at low temperature (point 158) is heated up to point 159. In 159 the water has an enthalpy such that, after lamination (transformation between point 159 and 156), the evaporation zone 157 is avoided.

The steam generator of the invention, allows, as said above, to solve the problem of "cycling", as it is very quick in the start up and in the power load increase/decrease within the nominal capacity.

The steam generators of the invention quickly reacts to load variations, and especially at low loads, and in particular lower than about 30%, because it overcomes the problems due to wide temperature profiles, along the water/steam pathway, deviation from those of maximum load. The steam generator of the invention can withstand the extension, towards a very large portion of the tube pathway, of temperatures close to the temperature of the incoming hot fumes. For this reason, the use, for a large portion of the heat exchange surface, of high alloyed materials for tubes (alloys with a high content of nickel, and other valuable metals) is not necessary. In this way the cost of the steam generator of the present invention is lower in comparison with other prior art steam generators.

In fact, in the steam generators of the invention:

The load can be quickly moved upward or downward in an wide load interval with operations carried out at constant control logic, that for the steam generators means to maintain the temperature profiles of fumes and of the water/steam, i.e. in the same alignment and geometrical position in the steam generator, condition known in the prior art as constant temperature profile control condition, or as "profile control". The flexibility of this embodiment, meant as quick load move upward or downward, with regulation systems operating at constant regulation logic, takes place also for loads lower than 30%.

In the operations under the limit of about 30% load in the steam generators of the invention the profile control is maintained and the steam generator can be operated in automated temperature profile control, constant over the whole range lower than 30% load, both in rising and in decreasing, in addition to quick start-up and downs.

Therefore the steam generators of the invention show high flexibility and can be made of materials even of a quality comparable to those used in traditional USC steam generators, that is the portion of tubes length in high alloyed materials is very limited. Besides, the steam generators of the invention are able to expand the flexibility towards the low loads (<30%), down to the limit close to an economically acceptable night stand-by condition (load at least below 10%, preferably higher than or equal to 5%), in a constant temperature "profile" control modality, ready to quickly raise to maximum load according to the requirements, also with fuels, as coal, which historically have been limited to power stations servicing the continuous production close to capacity.

The invention claimed is:

1. A process for operating a steam generator at loads from 5% to 100%, the steam generator comprising:

a cylindrical vessel having an axis; an inlet for water, an outlet for a superheated steam, a fumes inlet and a fumes outlet:

water/steam tubes passing through the cylindrical vessel from the inlet for water to the outlet for superheated steam; and headers for the superheated steam:

wherein:

the water/steam tubes are arranged in flat tube banks, and the flat tube banks form a sequence of flat tube banks that extend along a direction of the vessel axis, wherein the flat tube banks are crossed perpendicularly by a fumes flow that passes through the vessel from the fumes inlet to the fumes outlet;

the water/steam tubes are arranged horizontally and contiguous within the flat tube banks and pairs of flat tube banks are connected to one another by obliquely extending tubes such that water/steam tubes in each pair of flat tube banks are exposed to fumes at different positions along the direction of the vessel axis;

the water/steam tubes arranged in the flat tube banks are divided into two or more separate branches, wherein each branch is fed by a separate header;

the headers for the superheated steam are grouped together in a bundle, and the bundle of headers is thermally insulated from a region external to the steam generator; and the steam generator is a once-through type steam generator with fumes flow in counter-current with respect to water flow;

the process for operating the steam generator comprising steps of:

feeding water into the water/steam tubes and fumes through the fumes inlet;

flowing the fumes in counter-current with respect to water flowing inside the water/steam tubes thereby forming water/steam, the fumes and the water/steam exchanging heat through a heat exchange surface of the steam generator so that the fumes and the water/steam have respective temperature profiles along the vessel axis;

maintaining, in the steam generator, the temperature profiles of the fumes and the water/steam in a common position along the vessel axis; and choking the heat exchange surface of the steam generator so that operation at loads lower than 30% takes place by excluding and then maintaining in a dry condition one or more branches of the water/steam tubes, up to having only one operating branch.

2. The process according to claim 1, wherein the temperature profile of the fumes and the water/steam are maintained at a constant position along the vessel axis by performing two or more steps of:

a) for loads lower than 30%, choking the heat exchange surface by excluding and then maintaining in the dry condition one or more branches of the water/steam tubes, up to have only one operating branch of the water/steam tubes;

b) feedback control of feed water flow-rate at loads from 5% to 100% so that under loads requiring supercritical conditions which involve production of a supercritical fluid, the supercritical fluid is maintained in a first position along the vessel axis and under loads requiring subcritical pressure conditions which involve the production of a two-phase water/steam mixture, the two-phase water/steam mixture is maintained in a second position along the vessel axis;

c) feedback control of the temperature of the superheated steam at loads from 5% to 100% by inlet fume temperature tuning, by recycling fumes exiting from the fumes outlet of the vessel to a combustor operated with solid fuels;

d) feedback control of the temperature of the fumes at the fumes outlet of the vessel via feed water pre-heating.

3. The process according to claim 2, wherein the temperature profile of the fumes and the water/steam are maintained by carrying out steps b) and c).

4. The process according to claim 2, further comprising step e):

maintaining the steam generator under supercritical pressure conditions to produce a supercritical fluid at loads higher than 5% up to 100%, lamination of the supercritical fluid, and transformation of the supercritical fluid into steam only.

5. The process according to claim 1, wherein a feed-forward control is performed by increasing or decreasing the load of the steam generator.

6. The process according to claim 1, wherein a minimum load of the steam generator for achieving a temperature profile control condition is 5% load.

7. The process according to claim 1, wherein a minimum load of the one or more operating branch of water/steam tubes for achieving a load of 5-10% in the steam generator is 30%.

8. The process according to claim 1, wherein one water steam tube from the header of each of the one or more branches of water steam tubes form couples, terns or sets of four groups of contiguously grouped water/steam tubes.

9. The process according to claim 1, wherein in each pair of flat tube banks a water/steam tube reaches one end of the vessel and turns and extends to an opposite end of the vessel.

10. The process according to claim 2, wherein the steam generator is positioned downstream a combustor operated with solid fuels and the feedback control of the temperature of the superheated steam is carried out by modulating the temperature of fumes recycled from the fumes outlet and fed to the fumes inlet of the steam generator.

11. The process according to claim 1, wherein the headers for superheated steam are positioned in the fumes flow, said headers having piping outside the vessel collected in a bundle, wherein a thermal insulation is disposed around the bundle.

12. The process according to claim 1, wherein fumes entering the fumes inlet are under pressure.

13. The process according to claim 4, wherein operating the steam generator comprises a start-up phase wherein step e) of the process is carried out.

14. The process according to claim 13, wherein: the start-up phase is carried out by selecting a steam generator operating pressure so that at first water exiting the vessel of the steam generator is sub-cooled and then without forming a two-phase liquid water/steam mixture, pressure is made supercritical, steam is superheated; in the start-up phase a supercritical fluid is generated and the fluid is laminated and conveyed to a flash tank; and when water exiting the vessel of the steam generator has an enthalpy of about 150 kJ/kg higher than a saturated steam enthalpy at an admission pressure into a turbine, it is introduced into a start-up circuit of the turbine.

15. The process according to claim 13, wherein the start-up phase comprises:

heating of dry water/steam tubes of all the branches, feeding of the water/steam tubes of one branch with water at the supercritical pressure of 240-280 bar, heating the fumes, fluid lamination when water at the outlet of the steam generator has an enthalpy of about 150 kJ/kg higher than a saturated steam enthalpy at the inlet pressure of a turbine, or heating the fluid so that lamination produces superheated steam; and when a load equal to 30% of a fed one branch is reached, step b), step c) and step d) of claim 2 are carried out.

* * * * *